US009761157B2

(12) United States Patent
Cox et al.

(10) Patent No.: US 9,761,157 B2
(45) **Date of Patent: *Sep. 12, 2017**

(54) CUSTOMIZED SECTIONAL SIGN ASSEMBLY KIT AND METHOD OF USING KIT FOR CONSTRUCTION AND INSTALLATION OF SAME

(71) Applicant: ADTI MEDIA, LLC, Temecula, CA (US)

(72) Inventors: David Franklin Cox, Escondido, CA (US); Charles Allen Martindale, Winchester, CA (US); Arne E. Carlson, Ramona, CA (US)

(73) Assignee: ADTI Media LLC, Temecula, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/297,544

(22) Filed: Oct. 19, 2016

(65) Prior Publication Data

US 2017/0053570 A1 Feb. 23, 2017

Related U.S. Application Data

(60) Continuation-in-part of application No. 14/726,825, filed on Jun. 1, 2015, now Pat. No. 9,536,457, which
(Continued)

(51) Int. Cl.
*G09F 3/04* (2006.01)
*G09F 9/302* (2006.01)
(Continued)

(52) U.S. Cl.
CPC ..... *G09F 9/3026* (2013.01); *G09F 9/33* (2013.01); *G09F 15/0037* (2013.01);
(Continued)

(58) Field of Classification Search
CPC ..... G09F 9/33; G09F 9/3026; G09F 13/22; G09F 27/008; G09F 19/22; G06F 3/1446;
(Continued)

(56) References Cited

U.S. PATENT DOCUMENTS 5,563,470 A 10/1996 Li
5,693,170 A 12/1997 Li
(Continued)

FOREIGN PATENT DOCUMENTS

AU WO2004042690 5/2003
CN 101690395 1/2009
(Continued)

*Primary Examiner* — Shin Kim
(74) *Attorney, Agent, or Firm* — Jerry R. Potti; James R. McDaniel

(57) ABSTRACT

An electronic sign having at least one sectional sign assembly, the at least one sectional sign assembly having a signage support structure and an associated compound structural frame, wherein the compound structural frame has a unitary structural foam construction with a plurality of display module receiving bays, each configured for removably latching therein a plurality of display modules, the signage support structure and the associated compound structural frame cooperating when secured together to form a natural airflow cooling path extending from the top to the bottom of sectional sign assembly to provide sufficient cooling to the plurality of display modules when removably mounted within their display module receiving bays.

19 Claims, 21 Drawing Sheets

Related U.S. Application Data is a division of application No. 14/242,654, filed on Apr. 1, 2014, now Pat. No. 9,047,791, which is a continuation-in-part of application No. 14/214,778, filed on Mar. 15, 2014, which is a continuation-in-part of application No. 14/075,308, filed on Nov. 8, 2013, now Pat. No. 8,824,125, which is a continuation-in-part of application No. 14/056,017, filed on Oct. 17, 2013, now Pat. No. 8,824,124, which is a continuation-in-part of application No. 14/044,620, filed on Oct. 2, 2013, now Pat. No. 8,929,083, which is a continuation-in-part of application No. 13/844,832, filed on Mar. 16, 2013, now Pat. No. 9,330,583.

(51) Int. Cl.

| | |
|---|---|
| ***G09F 15/00*** | (2006.01) |
| ***G09F 19/22*** | (2006.01) |
| ***G09F 27/00*** | (2006.01) |
| ***G09F 9/33*** | (2006.01) |
| *G09F 7/18* | (2006.01) |

(52) U.S. Cl.
CPC ..... *G09F 19/22* (2013.01); *G09F 19/228* (2013.01); *G09F 27/008* (2013.01); *G09F 2007/1804* (2013.01)

(58) Field of Classification Search
CPC ..... G09G 3/32; G09G 2300/026; G09G 2300/0426; F21Y 2115/10; H05B 37/0254
See application file for complete search history.

(56) References Cited

U.S. PATENT DOCUMENTS

| | | | |
|---|---|---|---|
| 5,785,415 | A | 7/1998 | Matsumura et al. |
| 5,949,581 | A | 9/1999 | Kurtenbach et al. |
| 5,990,802 | A | 11/1999 | Maskeny |
| 6,065,854 | A | 5/2000 | West et al. |
| 6,150,996 | A | 11/2000 | Nicholson et al. |
| 6,169,632 | B1 | 1/2001 | Kurtenbach et al. |
| 6,175,342 | B1 | 1/2001 | Nicholson et al. |
| 6,237,290 | B1 | 5/2001 | Tokimoto et al. |
| 6,314,669 | B1 | 11/2001 | Tucker |
| 6,414,650 | B1 | 7/2002 | Nicholson et al. |
| 6,634,124 | B1 | 10/2003 | Bierschbach |
| 6,657,605 | B1 | 12/2003 | Boldt, Jr. et al. |
| 6,677,918 | B2 | 1/2004 | Yuhara et al. |
| 6,741,222 | B1 | 5/2004 | Tucker |
| 6,810,612 | B2 | 11/2004 | Huang |
| 6,813,853 | B1 | 11/2004 | Tucker |
| 7,055,271 | B2 | 6/2006 | Lutz et al. |
| 7,064,674 | B2 | 6/2006 | Pederson |
| 7,086,188 | B2 | 8/2006 | Tsao |
| 7,131,226 | B2 | 11/2006 | Gray et al. |
| 7,138,659 | B2 | 11/2006 | Raos et al. |
| 7,144,748 | B2 | 12/2006 | Popovich |
| 7,170,480 | B2 | 1/2007 | Boldt, Jr. et al. |
| 7,207,693 | B2 | 4/2007 | Ratcliffe |
| 7,224,347 | B2 | 5/2007 | Martin et al. |
| 7,284,881 | B2 | 10/2007 | Kim et al. |
| 7,287,878 | B2 | 10/2007 | Miller |
| 7,315,049 | B2 | 1/2008 | Raos et al. |
| 7,334,361 | B2 | 2/2008 | Schrimpf et al. |
| 7,355,562 | B2 | 4/2008 | Schubert et al. |
| 7,450,085 | B2 | 11/2008 | Thielemans et al. |
| 7,473,020 | B2 | 1/2009 | Pickering |
| 7,498,933 | B2 | 3/2009 | Pederson |
| 7,543,976 | B2 | 6/2009 | Abogabir |
| 7,576,707 | B2 | 8/2009 | Nishimura |
| 7,605,772 | B2 | 10/2009 | Syrstad |
| 7,612,736 | B2 | 11/2009 | Nakajima |
| 7,614,771 | B2 | 11/2009 | McKechnie et al. |
| 7,682,043 | B2 | 3/2010 | Malstrom et al. |
| 7,688,280 | B2 | 3/2010 | Callegari et al. |
| 7,703,941 | B2 | 4/2010 | Lee |
| 7,774,968 | B2 | 8/2010 | Nearman et al. |
| 7,779,568 | B2 | 8/2010 | Gettelfinger et al. |
| 7,797,865 | B2 | 9/2010 | Patel et al. |
| 7,868,903 | B2 | 1/2011 | Wendler et al. |
| 7,869,198 | B1 | 1/2011 | Nearman et al. |
| 7,928,968 | B2 | 4/2011 | Shon et al. |
| 7,971,378 | B2 | 7/2011 | Campo y Odena |
| 8,007,121 | B2 | 8/2011 | Elliott et al. |
| 8,016,452 | B2 | 9/2011 | Dunn |
| 8,074,387 | B2 | 12/2011 | Mancuso |
| 8,111,208 | B2 | 2/2012 | Brown |
| 8,172,097 | B2 | 5/2012 | Nearman et al. |
| 8,183,794 | B2 | 5/2012 | Grajcar |
| 8,228,261 | B2 | 7/2012 | Callegari et al. |
| 8,246,220 | B2 | 8/2012 | Epstein et al. |
| 8,362,696 | B2 | 1/2013 | Zheng |
| 8,414,149 | B2 | 4/2013 | Nearman et al. |
| 2001/0037591 | A1 | 11/2001 | Nicholson et al. |
| 2002/0122134 | A1 | 9/2002 | Kalua |
| 2003/0058191 | A1 | 3/2003 | Yubara et al. |
| 2003/0210236 | A1 | 11/2003 | Martin et al. |
| 2004/0104871 | A1 | 6/2004 | Boldt, Jr. et al. |
| 2004/0123501 | A1 | 7/2004 | Safavi et al. |
| 2005/0081414 | A1 | 4/2005 | Lutz et al. |
| 2005/0151708 | A1 | 7/2005 | Farmer et al. |
| 2005/0178034 | A1 | 8/2005 | Schubert et al. |
| 2005/0212717 | A1 | 9/2005 | Baumstark |
| 2005/0231949 | A1 | 10/2005 | Kim et al. |
| 2005/0259036 | A1 | 11/2005 | Callegari et al. |
| 2005/0259418 | A1 | 11/2005 | Callegari et al. |
| 2006/0055641 | A1 | 3/2006 | Robertus et al. |
| 2006/0056169 | A1 | 3/2006 | Lodhie et al. |
| 2006/0171148 | A1 | 8/2006 | Huang |
| 2006/0244681 | A1 | 11/2006 | Nakajima |
| 2006/0279493 | A1 | 12/2006 | Syrstad |
| 2007/0000849 | A1 | 1/2007 | Lutz et al. |
| 2007/0008259 | A1 | 1/2007 | Baker |
| 2007/0068055 | A1 | 3/2007 | Segan et al. |
| 2007/0081341 | A1 | 4/2007 | Raos et al. |
| 2007/0086187 | A1 | 4/2007 | Raos et al. |
| 2007/0086188 | A1 | 4/2007 | Raos et al. |
| 2007/0086189 | A1 | 4/2007 | Raos et al. |
| 2008/0130282 | A1 | 6/2008 | Negley |
| 2008/0141571 | A1 | 6/2008 | Kowittz |
| 2008/0141572 | A1 | 6/2008 | Tomich et al. |
| 2008/0263924 | A1 | 10/2008 | Nearman et al. |
| 2008/0266206 | A1 | 10/2008 | Nelson et al. |
| 2009/0009103 | A1 | 1/2009 | McKchnie et al. |
| 2009/0015997 | A1 | 1/2009 | Barajas et al. |
| 2009/0040137 | A1 | 2/2009 | Callegari et al. |
| 2009/0058760 | A1 | 3/2009 | Aoki |
| 2009/0128461 | A1 | 5/2009 | Geldard et al. |
| 2009/0146910 | A1 | 6/2009 | Garner |
| 2009/0146918 | A1 | 6/2009 | Kleine et al. |
| 2009/0146919 | A1 | 6/2009 | Kleine et al. |
| 2009/0190353 | A1 | 7/2009 | Barker |
| 2009/0241388 | A1 | 10/2009 | Dunn |
| 2009/0284978 | A1 | 11/2009 | Elliot et al. |
| 2009/0289160 | A1 | 11/2009 | Kludt et al. |
| 2010/0019535 | A1 | 1/2010 | Chang et al. |
| 2010/0090934 | A1 | 4/2010 | Elliot et al. |
| 2010/0123732 | A1 | 5/2010 | Jenks et al. |
| 2010/0171686 | A1 | 7/2010 | Callegari et al. |
| 2010/0251583 | A1 | 10/2010 | Brown et al. |
| 2011/0002129 | A1 | 1/2011 | Zheng et al. |
| 2011/0019414 | A1 | 1/2011 | Jiang et al. |
| 2011/0051409 | A1 | 3/2011 | Nearman |
| 2011/0057215 | A1 | 3/2011 | Chen et al. |
| 2011/0072697 | A1 | 3/2011 | Miller |
| 2011/0074833 | A1 | 3/2011 | Murayama et al. |
| 2011/0085321 | A1 | 4/2011 | Eli |
| 2011/0089824 | A1 | 4/2011 | Zheng |
| 2011/0090138 | A1 | 4/2011 | Zheng |
| 2011/0102307 | A1 | 5/2011 | Wendler |
| 2011/0116232 | A1 | 5/2011 | Brown et al. |
| 2011/0181495 | A1 | 7/2011 | Chu |
| 2011/0188235 | A1 | 8/2011 | Bollmann |

(56) References Cited

U.S. PATENT DOCUMENTS

| | | | |
|---|---|---|---|
| 2011/0188981 | A1 | 8/2011 | Bonn |
| 2011/0215992 | A1 | 9/2011 | Kleine et al. |
| 2011/0219650 | A1 | 9/2011 | Wright |
| 2011/0221662 | A1 | 9/2011 | Klein et al. |
| 2011/0235332 | A1 | 9/2011 | Cheung |
| 2012/0206277 | A1 | 8/2012 | Cai |

FOREIGN PATENT DOCUMENTS

| | | |
|---|---|---|
| EP | 1534992 | 6/2005 |
| IT | EP0863496 | 3/1997 |
| JP | WO2008015762 | 2/2009 |
| KR | WO2007083879 | 1/2006 |
| KR | WO2011059247 | 11/2009 |
| KR | WO2011162570 | 6/2010 |
| PL | EP 2042983 | 8/2010 |
| RU | WO2009064219 | 11/2007 |
| RU | WO2009104982 | 2/2008 |
| WO | WO2009008964 | 1/2009 |
| WO | WO2009008986 | 1/2009 |

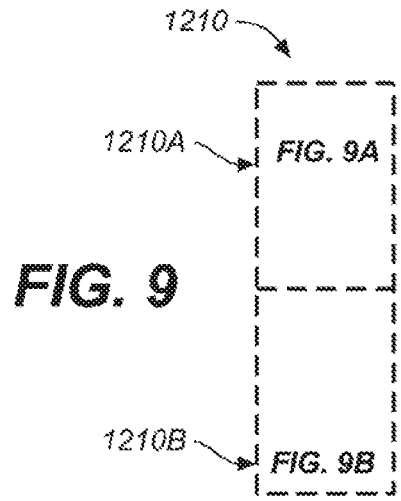
FIG. 9
FIG. 9A
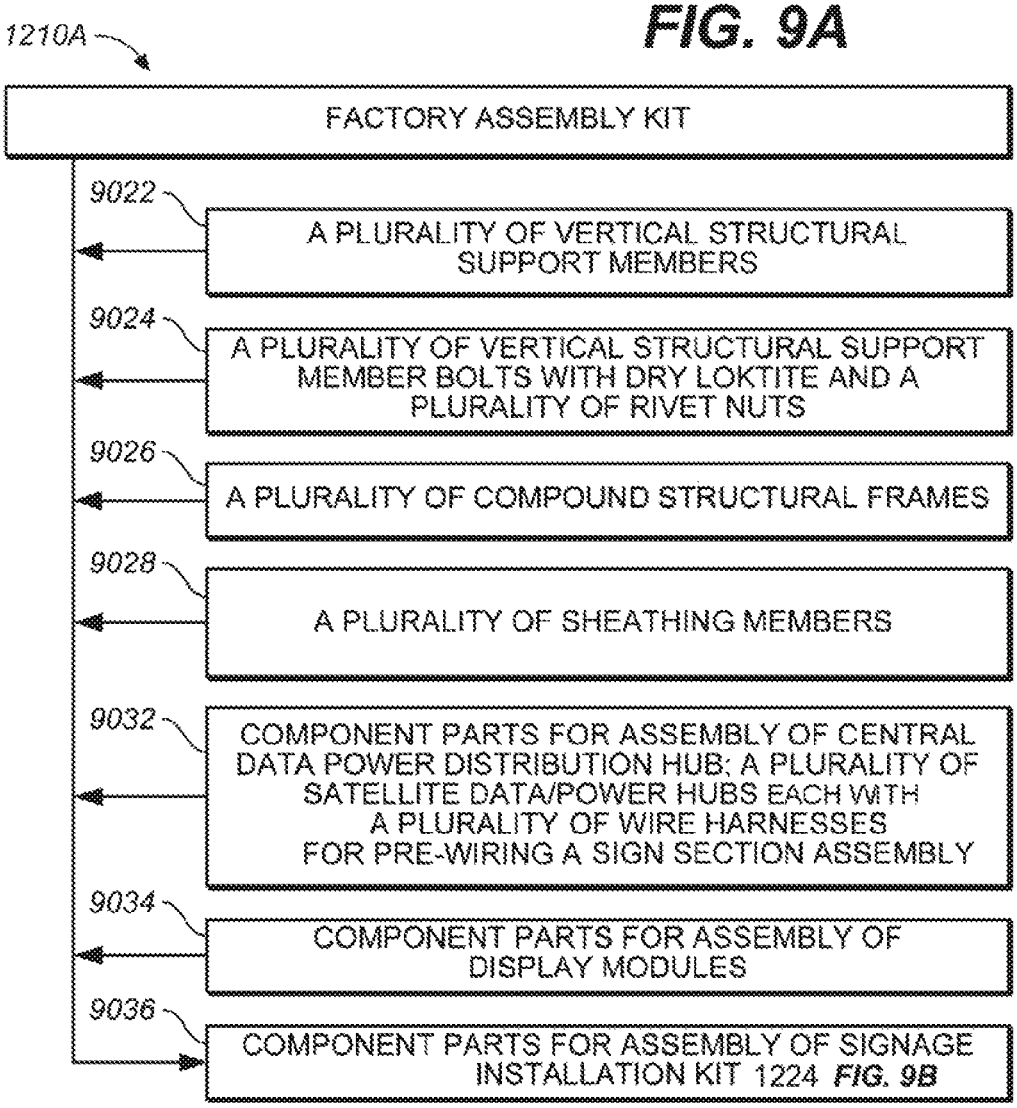

CUSTOMIZED SECTIONAL SIGN ASSEMBLY KIT AND METHOD OF USING KIT FOR CONSTRUCTION AND INSTALLATION OF SAME

RELATED APPLICATIONS

This application is a continuation-in-part utility patent application claiming priority to U.S. patent Ser. No. 14/726,825, filed on Jun. 1, 2015, which is a divisional utility patent application of U.S. patent Ser. No. 14/242,654, filed on Apr. 1, 2014, now U.S. Pat. No. 9,047,791, issued on Jun. 2, 2015, which is a continuation-in-part of U.S. patent application Ser. No. 14/214,778, entitled "Sectional Sign Assembly and installation Kit and Method of Using Same", by David Franklin Cox, et al. filed on Mar. 15, 2014, as a continuation-in-part of U.S. patent application Ser. No. 14/075,308, entitled Modular Installation and Conversion Kit for Electronic Sign Structure and Method of Using Same", by David Franklin Cox, et al. filed on Nov. 8, 2013, now U.S. Pat. No. 8,824,125, which is a continuation-in-part patent application of U.S. patent application Ser. No. 14/056,017 entitled, "Modular Wire Harness Arrangements and Methods of Using Same for Back-side to Front-side Power and Data Distribution Safety Schemes", by Arne E. Carlson. et al. filed on Oct. 17, 2013, now U.S. Pat. No. 8,824,124, which is a continuation-in-part patent application of U.S. patent application Ser. No. 14/044,620 entitled; "Compound Structural Frame and Method of Using Same for Efficient Retrofitting", by David Franklin Cox; et al. filed on Oct. 2, 2013, now U.S. Pat. No. 8,929,083, which is a continuation-in-part patent application of U.S. patent application Ser. No. 13/844,832, entitled, "In Field Kit for Converting a Non Electronic Billboard into an Electronic Billboard, and Methods of Retrofitting and Using Same", by David Franklin Cox, et al. filed on Mar. 16, 2013, now U.S. Pat. No. 9,330,583, which applications are each incorporated herein as though fully set forth.

FIELD OF INVENTION

This invention relates generally to roadside and building signage, and more particularly to an electronic sign and installation kit for in factory and in-field use to either retrofit a static non-electronic sign into a dynamic electronic sign for roadside or building signage use or for the installation of a new electronic sign for roadside or building signage use.

BACKGROUND OF THE INVENTION

Retrofitting non-digital have proven to be expensive, time consuming and labor intensive. Moreover, simply removing an older non-digital sign and replacing it with a new digital sign has not proven entirely satisfactory either since older installed, non-digital, panels represent substantial capital outlays making it financially difficult, if not impossible, to discard such panels arbitrarily for replacement with digital panels. Therefore, it would be highly desirable to have a new and improved sign retrofit kit that can be easily and quickly installed on any signage mounting structure, such as a new signage mounting structure or an existing signage mounting structure, whichever the case may be. The new and improved sign retrofit kit should greatly improve displayed information, displaying such advertising information, with improved resolution, contrast and brightness characteristics. Moreover, the retrofit kit should enable the displayed content to be easily and quickly changed or updated, either on-site or remotely, at a lesser cost than updating the content of an older sign. Finally, installation of the kit in the field on any signage mounting structure should not require any special installation equipment and should be able to be accomplished by one or two individuals in a fast and convenient manner.

SUMMARY OF INVENTION

Throughout this specification the word "comprising", or variations such as "comprise", or "comprises", will be understood to imply the inclusion of a stated element, integer or step, or group of elements, integers or steps, but not the exclusion of any other element, integer or step, or group of elements, integers, or steps.

In a first aspect, the present invention is an electronic sign configured to be secured to a signage mounting structure, where the electronic sign generally comprises at least one pre-wired sectional sign assembly having a front-side defining an array of display module receiving bays, wherein each display module receiving bay has removably latched therein a display module and wherein at least one of the display module receiving bays has mounted therein a condensed extender enclosure electrically coupled between a power converter mounted proximate to the signage mounting structure and a plurality of cord-like extensions, each extension terminating at a corresponding individual one of the display module receiving bays and each terminating in a power plug configured to be coupled to a complementary power plug extending from a corresponding individual one of the display modules: and a coupling structure mounted to a back-side of the at least one pre-wired sectional sign assembly, the coupling structure having at least a pair of spaced apart vertical beams with a sheeting member mounted therebetween to help facilitate the formation of an airflow vent between the pre-wired sectional sign assembly and the coupling structure for providing natural airflow cooling for each display module removably latched in a corresponding one of the display module receiving bays; wherein each beam is configured to carry at least one mounting bracket to facilitate mounting the pre-wired sectional sign assembly to the signage mounting structure.

In a first embodiment of the first aspect of the present invention, the at least one pre-wired sectional sign assembly includes at least one structural frame having a front-side and a back-side, the front-side defining the array of display module receiving bays and the back-side having at least one airflow channel for receiving therein a cooling designated portion of individual ones of the display modules to provide the cooling designated portion with natural air flow cooling from air flowing within the airflow vent.

In a second embodiment of the first aspect of the present invention, each individual vertical beam has a frame mounting surface, a channel opposing the frame mounting surface, and a pair of opposing sheeting member mounting surfaces.

In a third embodiment of the first aspect of the present invention, the sheeting member is mounted between opposing sheeting member mounting surfaces and wherein the back-side of the at least one structural frame is mounted to the frame mounting surface of each of the at least a pair of spaced apart vertical beams.

In a fourth embodiment of the first aspect of the present invention, the at least one structural frame has a unitary construction.

In a fifth embodiment of the first aspect of the present invention, the at least one structural fame is composed of structural foam.

In a second aspect of the present invention, an electronic sign generally comprises a sign section assembly having a front portion and a rear portion; said front portion defining an array of display module receiving bays, and said rear portion configured to be coupled to a beam surface of a signage mounting structure; and a power routing system including a power converting system mounted proximate to the signage mounting structure and at least one power distribution extension system coupled electrically between the power converting system and a plurality of power extensions, wherein each individual one of the plurality of power extensions terminate in corresponding individual ones of the display module receiving bays to facilitate coupling power to individual ones of a plurality of display modules removably latched within the corresponding individual ones of the display module receiving bays.

In a first embodiment of the second aspect of the present invention, the at least one sign section assembly includes a plurality of structural frames secured to at least one structural signage support; and wherein each individual one of the plurality of structural frames is provided with an condensed extender enclosure mounted within an individual one of the display module receiving bays, wherein the condensed extender forms part of the power routing system and includes the plurality of power extensions.

In a second embodiment of the second aspect of the present invention, the sign section assembly includes at least one structural frame secured to at least one structural signage support; wherein the at least one structural signage support includes at least a pair of spaced apart vertical beams, each vertical beam having mounted thereto at least one mounting bracket for helping to support the sign section assembly to the signage mounting structure; wherein the at least one structural signage support further includes at least one sheeting member with upwardly extending side wall members to facilitate mounting of the at least one sheeting member between the at least a pair of spaced apart vertical beams; and wherein the at least one sheeting member is spaced a sufficient distance from a back-side of the at least one structural frame to help form a natural airflow chimney therebetween, the natural airflow chimney extending from a top-side of the at least one structural frame a bottom-side of the at least one structural frame to facilitate cooling the individual ones of the plurality of display modules removably latched within the corresponding individual ones of the display module receiving bays.

In a third embodiment of the second aspect of the present invention, each individual vertical beam is a strut formed from a metal sheet, folded over into an open box-like channel shape having a base member with rearwardly extending spaced apart legs members with inwardly formed lips for receiving therebetween the at least one mounting bracket; and wherein the rearwardly extending spaced apart leg members are provided with a plurality of mounting holes to facilitate the mounting of the at least one sheeting member between the at least a pair of spaced apart vertical beams.

In a fourth embodiment of the second aspect of the present invention, the electronic sign further comprises a data routing system coupled to the at least one power distribution extension system to facilitate providing display data to individual ones of the plurality of display modules.

In a fifth embodiment of the second aspect of the present invention, the power converting system mounted proximate to the signage mounting structure includes a primary power enclosure having disposed therein a power converter coupled to a source of high voltage alternating current power; and wherein the power converted is an AC to DC power converter for converting high voltage alternating current power to low voltage direct current power; and wherein each individual one of the plurality of power distribution extension systems includes at least one condensed extender enclosure mounted within an individual one of the display module receiving bays, the condensed extender enclosure having mechanically and electrically mounted thereto the plurality of power extensions.

In a sixth embodiment of the second aspect of the present invention, each individual one of the plurality of power extensions terminate in corresponding individual power plug, each configured to be mechanically and electrically coupled to a corresponding complementary display module power plug to facilitate coupling power to individual ones of the plurality of display modules as each is received within corresponding individual ones of the display module receiving bays.

In a seventh embodiment of the second aspect of the present invention, each display module includes a front-facing portion and a rear facing portion, wherein the front facing portion is mounted within a corresponding one of the display module receiving bays to facilitate forming a portion of the display area of the electronic sign; and wherein the rear facing portion is mounted within the natural airflow chimney extending from the bottom-side of the at least one structural frame to the top-side of the at least one structural frame to facilitate cooling the individual ones of the plurality of display modules removably latched within the corresponding individual ones of the display module receiving bays.

In an eighth embodiment of the second aspect of the present invention, each individual one of the plurality of power distribution extension systems includes at least one condensed extender enclosure mounted within an individual one of the display module receiving bays, the condensed extender enclosure having mechanically and electrically mounted thereto the plurality of power extensions.

In a ninth embodiment of the second aspect of the present invention, the sign section assembly includes at least two structural frames secured to at least one structural signage support; wherein the at least one structural signage support includes at least a pair of spaced apart vertical beams, each vertical beam having mounted thereto at least one mounting bracket for helping to support the sign section assembly to a signage mounting structure; wherein the at least one structural signage support further includes at least one sheeting member with a pair of upstanding side walls to facilitate mounting of the at least one sheeting member between the at least a pair of spaced apart vertical beam; and wherein the at least one sheeting member and the at least two structural frames cooperate when mounted to the at least one structural signage support to help form a natural airflow chimney therebetween, the chimney extending from a top-side of the sign section assembly to a bottom-side of the sign section assembly to facilitate cooling the individual ones of the plurality of display modules removably latched within the corresponding individual ones of the display module receiving bays.

In a tenth embodiment of the second aspect of the present invention, the power converting system mounted proximate to the signage mounting structure includes a primary power enclosure having disposed therein a power converter coupled to a source of high voltage alternating current power, the power converter for converting high voltage AC power to low voltage DC power; and wherein each individual one of the plurality of power distribution extension systems includes at least two condensed extender enclosures, each mounted in an individual one of the display module receiving bays in a corresponding one of the structural frames; and wherein each individual one of the at least two condensed extender enclosures have mechanically and electrically mounted thereto the plurality of power extensions.

In an eleventh embodiment of the second aspect of the present invention, the at least two structural frames are mounted in a stack in a dove-tailed configuration; and wherein the at least two structural frames, each have a unitary construction and are composed of injected structural foam.

In a third aspect of the present invention, an electronic sign generally comprises at least one sectional sign assembly loaded with a plurality of display modules, the at least one sectional sign assembly having at least one structural frame mounted to a signage support for facilitating providing the plurality of display modules with natural airflow cooling and for helping to facilitate the lifting and mounting of the at least one sectional sign assembly to a signage mounting structure.

In a first embodiment of the third aspect of the present invention, a power converting system for converting high voltage alternating current electrical power into a source of low voltage direct current electrical power, the power converting system being mounted proximate to the existing signage mounting structure and the sectional sign assembly; wherein the signage support includes at least a pair of spaced apart vertical beam members, each beam configured to have mounted thereto at least one mounting bracket for helping to support the at least one sectional sign assembly from the signage mounting structure, and at least one sheeting member mounted between the at least a pair of spaced apart vertical beams to help provide the signage support with a front-wall configuration to facilitate the forming of a natural airflow chimney; wherein the sectional sign assembly mounted to the signage support is arranged in a generally rectangular configuration with a front-facing portion, a rear-facing portion, a top surface, a bottom surface, a right-side surface and a left-side surface, wherein the sectional sign assembly and the at least one sheeting member of the signage support when mounted to the at least a pair of spaced apart vertical beam members cooperate to form the natural air flow chimney; wherein the front-facing portion and the rear-facing portion in combination define a plurality of display module receiving bays, each display module receiving bay having removably latched therein a display module with one portion thereof mounted within the natural airflow chimney and another portion thereof mounted within the front-facing portion, the another portion including a power plug for facilitating providing the display module with low voltage direct current electrical power; wherein one of the plurality of display module receiving bays has mounted therein an condensed extender enclosure with a plurality of display module power cords, each display module power cord terminating in a complementary power plug configured to be electrically and mechanically coupled to a display module power plug when the corresponding display module is received within a corresponding display module receiving bay; and a power routing systems coupled mechanically and electrically between the power converting system and the condensed extender enclosure for providing the plurality of display module power cords with low voltage direct current electrical power.

BRIEF DESCRIPTION OF DRAWINGS

The above mentioned features and steps of the invention and the manner of attaining them will become apparent, and the invention itself will be best understood by reference to the following description of the embodiments of the invention in conjunction with the accompanying drawings wherein:

FIGS. 9, 9A, and 9B are block diagrams of an assembly kit for assembling the digital electronic sign of FIG. 1, illustrating its component kit portions, including a factory assembly kit portion and a field assembly kit portion, each kit portion constructed in accordance with the present invention;

DETAILED DESCRIPTION OF PREFERRED EMBODIMENTS

Figure 1:
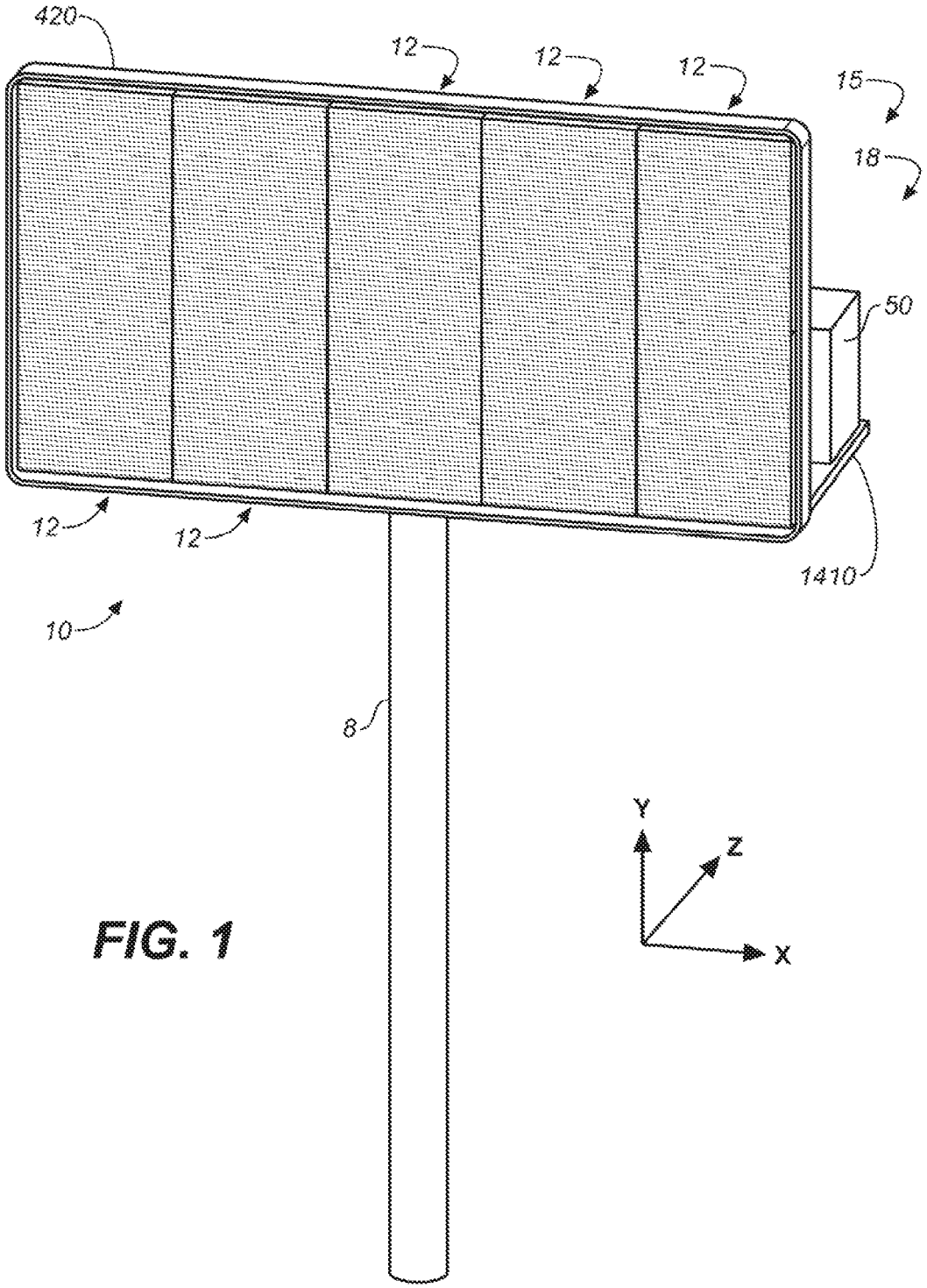
FIG. 1 is a front perspective view of a digital electronic sign constructed in accordance with the present invention and configured with a plurality of sectional sign assembly units, each having a plurality of display modules.

Referring now to the drawings and more particularly to FIGS. 1-7, there is illustrated a digital electronic sign 10 which is constructed in accordance with the present invention. The digital electronic sign 10 has a modular-like construction which may be customized as required by each sign installation site. The electronic sign 10 generally includes at least one pre-wired sectional sign assembly 12 which is configured to be electrically coupled to a power/data routing system 15. Each sectional sign assembly 12 is configured to be mounted to or supported by a conventional signage mounting structure, which may be an existing signage mounting structure or a newly installed signage mounting structure. In this regard, the signage mounting structures may include pole-like structures, such as a mounting pole structure 8 or a frame-like structure 1410 comprised of horizontal and vertical beams interconnected by angle irons and the like. Since these signage mounting structures are well known to those skilled in the art of sign constructions, they will not be described hereinafter in greater detail.

Figure 2:
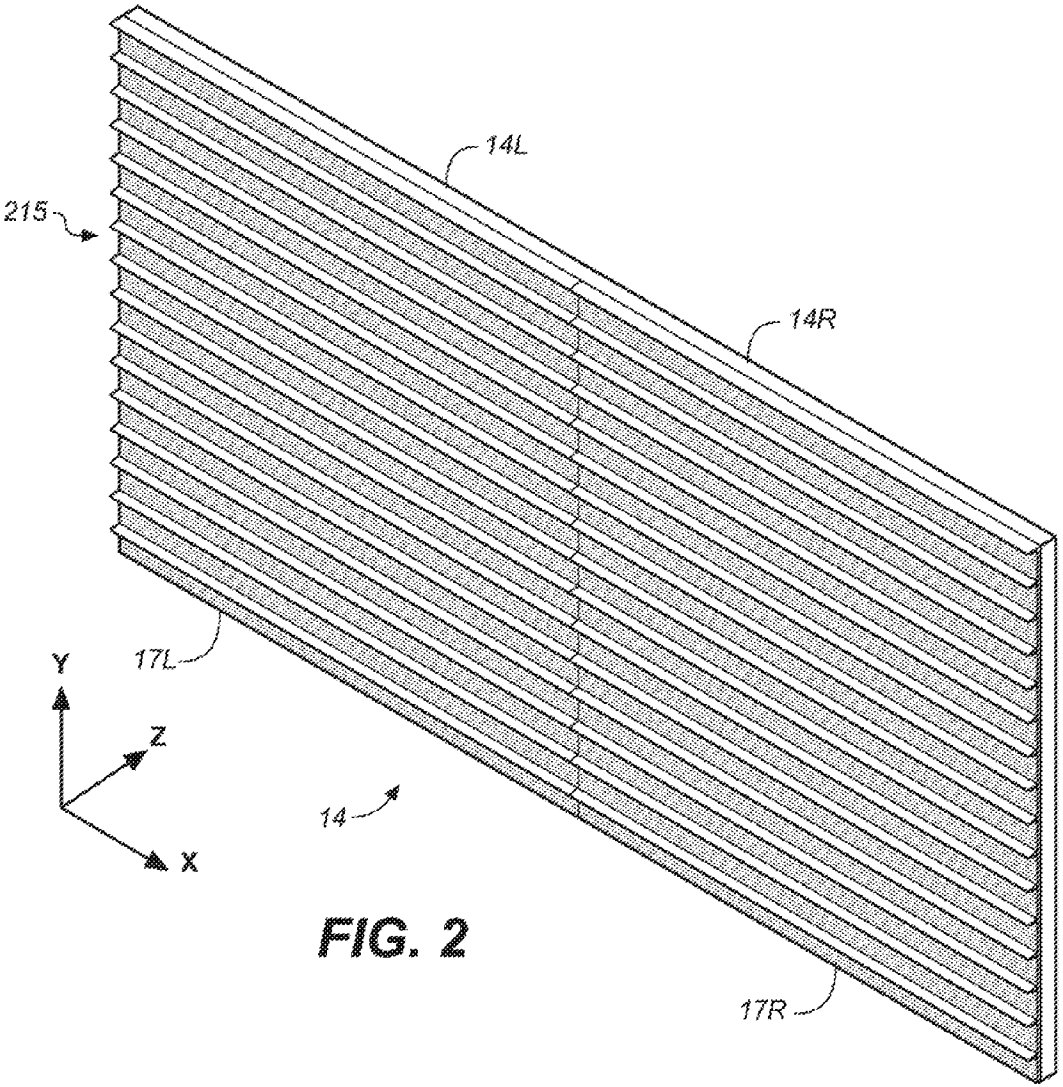
FIG. 2 is a front-side perspective view of a display module forming part of the digital electronic sign of FIG. 1.
Figure 3:
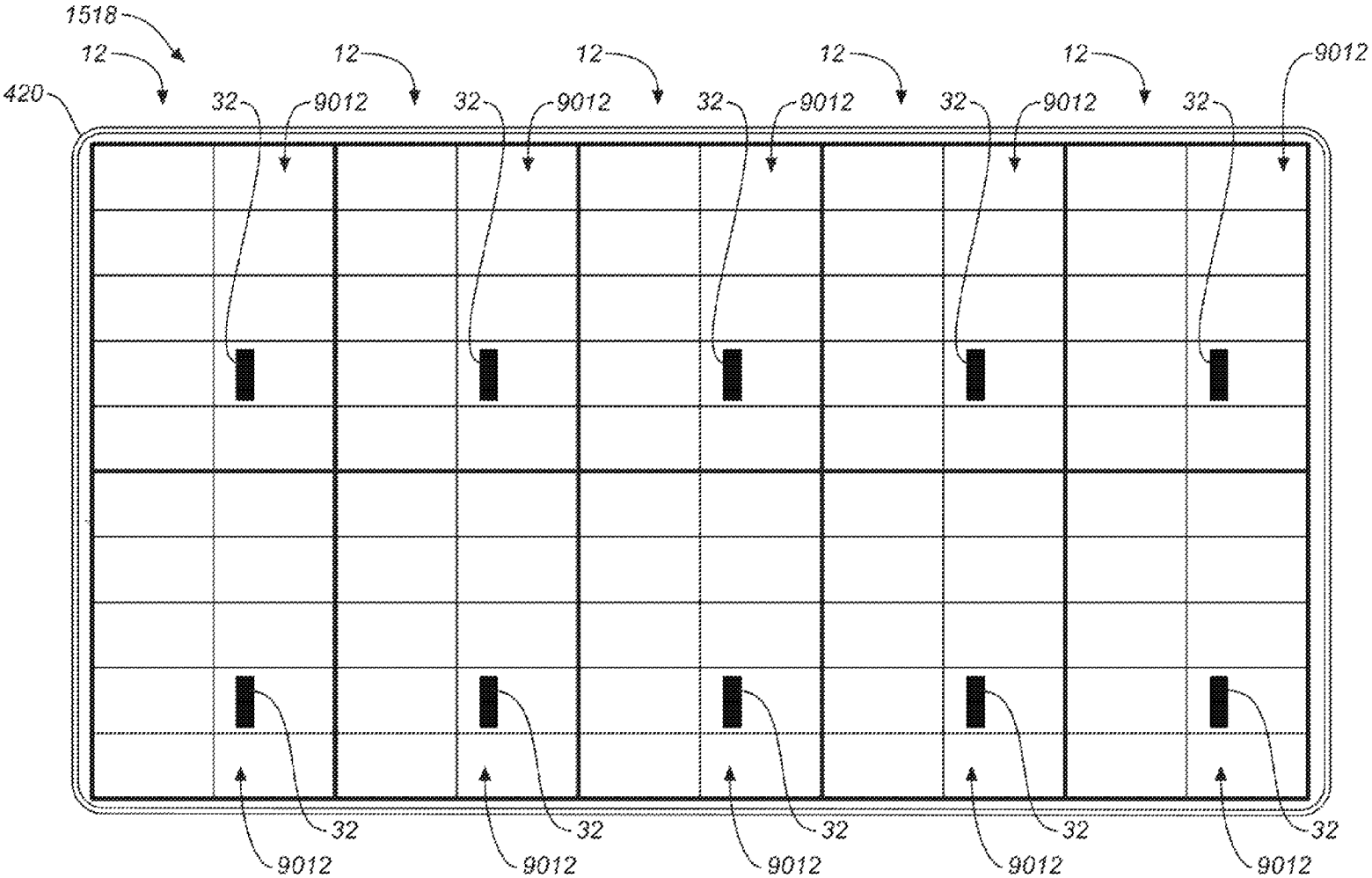
FIG. 3 is a diagrammatic front elevational view of the digital electronic sign of FIG. 1 with its display modules removed to illustrate placement of a plurality of satellite power/data hubs forming part of the digital electronic sign of FIG. 1.
Figure 6:
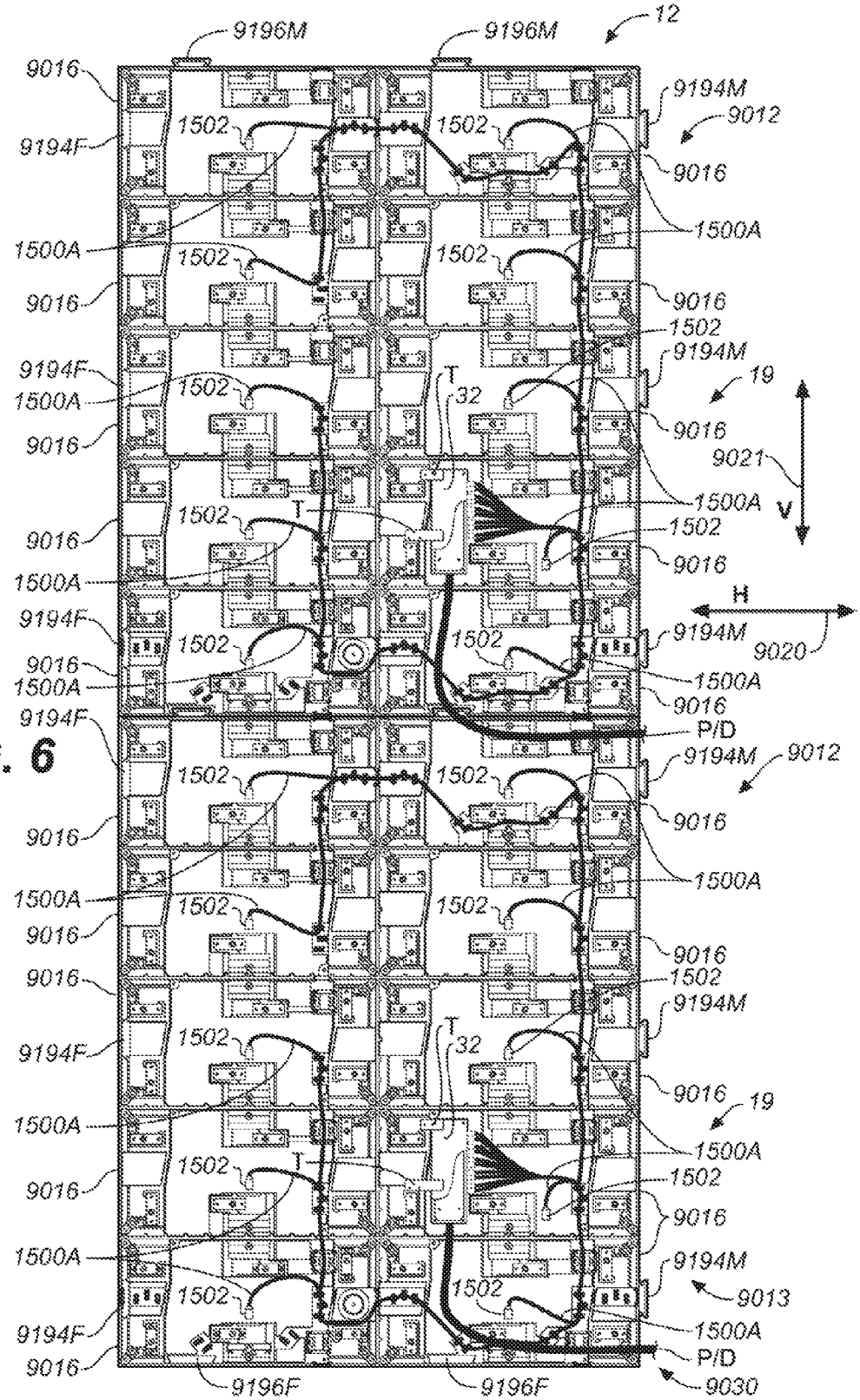
FIG. 6 is a diagrammatic view of a pair of pre-wired sectional sign assembly units with display modules removed illustrating a portion of the power/data routing system of FIG. 5.
Figure 12:
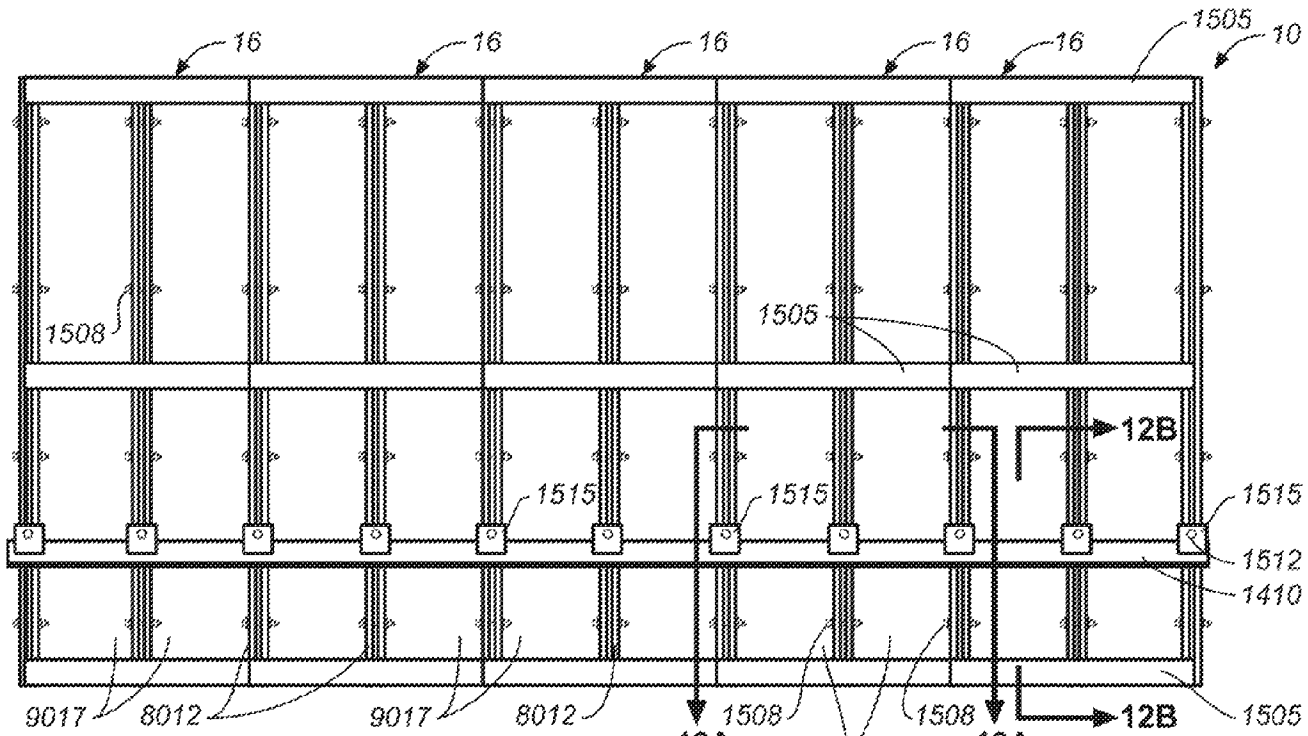
FIG. 12 is a rear elevational view of the digital electronic sign of FIG. 1, illustrating its structural signage support structures and their associated vertical channels and sheathing members.

Considering now the digital electronic sign 10 in greater detail with reference to FIGS. 6 and 12, the pre-wired sectional sign assembly 12 generally includes at least one compound structural frame 9012 and at least one corresponding coupling or structural support assembly 16. The compound structural frame 9012 has a unitary construction composed of structural foam, which is configured with a plurality of display module receiving bays, such as a display module receiving bay 9016. The compound structural frame 9012 is provided with several unique and novel features not heretofore found in the construction of digital electronic signs. These unique and novel features will be described hereinafter in greater detail. For now, it will suffice to mention that each display module receiving bay is configured to receive and removably latch therein an LED display modules, such as a LED display module 14 as best seen in FIG. 2.

Each structural support assembly 16 is configured to be mounted by its back or rear-side to a signage mounting structure, such as the signage mounting structure 1410. The front-side of the structural support assembly 16 is configured to be secured in a front-side to back-side relationship with a compound structural frame 9012. In this regard, the structural support assembly 16 provides rigidity to the compound structural frame 9012 and it further helps to facilitate the lifting and mounting of the compound structural frame 9012 to the signage mounting structure 1410 in a fast and efficient manner for ease in assembly installation of the electronic sign 10. The structural support assembly 16 in cooperation with a corresponding compound structural frame 9012 helps form or define a natural air-flow vent or chimney V that extends from the bottom of the compound structural frame 9012 to the top of the compound structural frame 9012. It should be noted that the unique construction of the sectional sign assembly 12 provided by the structural support assembly 16 and the compound structural frame 9012, facilitates dovetail coupling of sectional sign assemblies in side-by-side and top-to-bottom configurations. In this regard, pre-wired sectional sign assemblies may be coupled together in pre-configured sections at the factory level and then shipped to an on-site location, where the pre-wired sectional sign assemblies may be lifted and mounted on a section by section basis to the signage mounting structure 1410. The exact number of sectional sign assemblies utilized in the construction of a digital electronic sign, such as the digital electronic sign 10, is then simply a function of the overall size of the digital electronic sign being constructed. This unique modular-like construction of factory pre-assembly coupled with simple on-site final assembly processes, greatly reduces not only shipping costs, but also greatly reduces construction and installation time and costs.

It should be mentioned at this point, that the electrical coupling of the power/data routing system 15 to the pre-wired sectional sign assembly or assemblies 12, as the case may be, is yet another unique and novel feature of the present invention. In this regard, a distributed power/data arrangement is implemented in the present invention. More particularly, the power/data routing system 15 generally includes a primary power/data hub 18 (FIG. 5) that may be mounted either on the signage mounting structure (8, 1410) or at a convenient location adjacent to the signage mounting structure. In this regard, a source of high voltage alternating current power is brought into the input side of the primary power/data hub 18 where the high voltage alternating current power is rectified by a conventional AC to DC converter 20 to provide low voltage direct current power on its output side. As will be explained hereinafter in greater detail, the low voltage direct current power provided by the AC to DC converter 20 of the power/data routing system 15 is coupled to at least one satellite power/data hub 19. The satellite power/data hub 19, in turn, facilitates the distribution of data and low voltage power throughout an associated sectional sign assembly 12. From the foregoing, it should be understood by those skilled in the art that the power/data routing system 15 is configured so that only low voltage direct current power is provided to the pre-wired sectional sign assembly units of a digital electronic sign 10. The providing of only low voltage direct current power to the pre-wired sectional sign assembly units 12 of the electronic sign 10 is an important feature of the present invention as this configuration greatly reduces or completely eliminates the dangers of electrical shock to installation and construction personnel that could otherwise occur accidentally through the use of high voltage alternating current power.

Figure 9B:
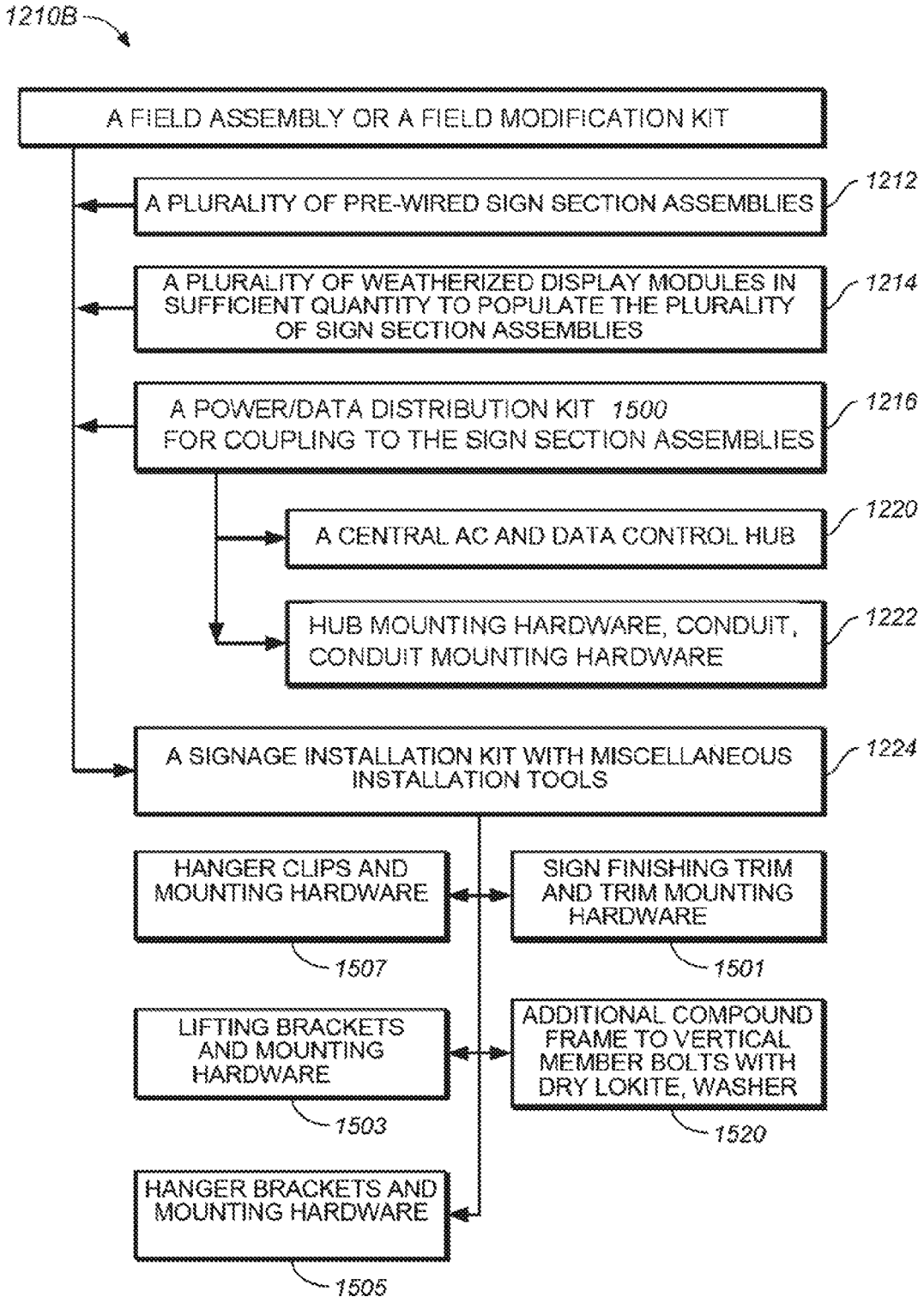
Figure 10:
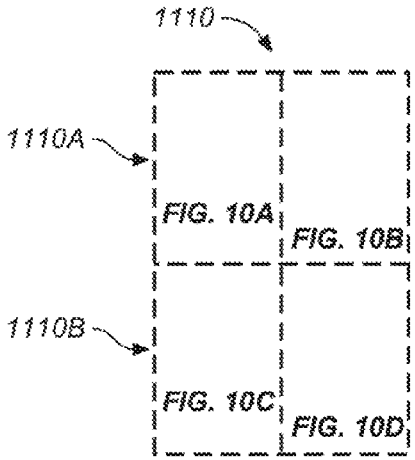
FIGS. 10, 10A-D is a method of using the factory assembly kit and field assembly kit of FIG. 9.

Considering now the digital electronic sign 10 in still greater detail, the digital electronic sign 10 is assembled, constructed and installed utilizing a unique sign assembly and installation kit 1210 (FIG. 9), which includes a factory assembly kit portion 1210A (FIG. 9A) and a field assembly or field modification kit portion 1210B (FIG. 9B). The sign assembly and installation kit 1210, in combination with a novel method of using the kits 1110, as best seen in FIG. 10, function in combination to assemble, construct and install the electronic sign 10, and like electronic signs with different sectional sign assembly unit configurations. In short, by use of these kits 1110 and 1210 respectively, a static non-electronic sign mounting structure, such as a sign mounting structure 8 (1410) as best seen in FIGS. 1 and 12, is transformed or converted into a digital electronic sign 10 that displays dynamic advertising or general information with high quality resolution, contrast, and scalable characteristics. It will become apparent to those skilled in the art, the methods described herein are applicable to any signage mounting structure, regardless of whether it is an existing signage mounting structure or a new signage mounting structure. Accordingly, there is no intention of limiting the claimed invention to either an existing signage mounting structure 8 or to a new signage mounting structure 1410.

Figure 10A:
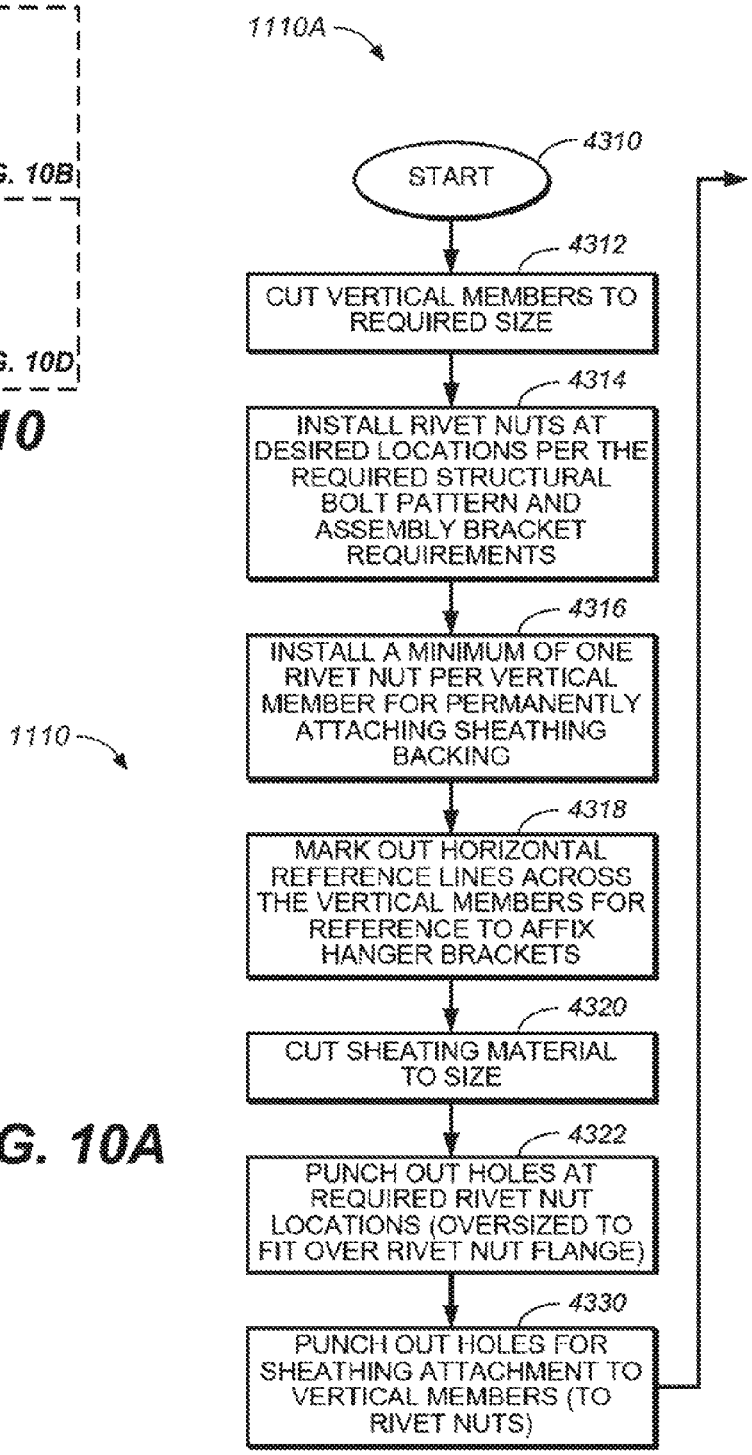
Figure 10B:
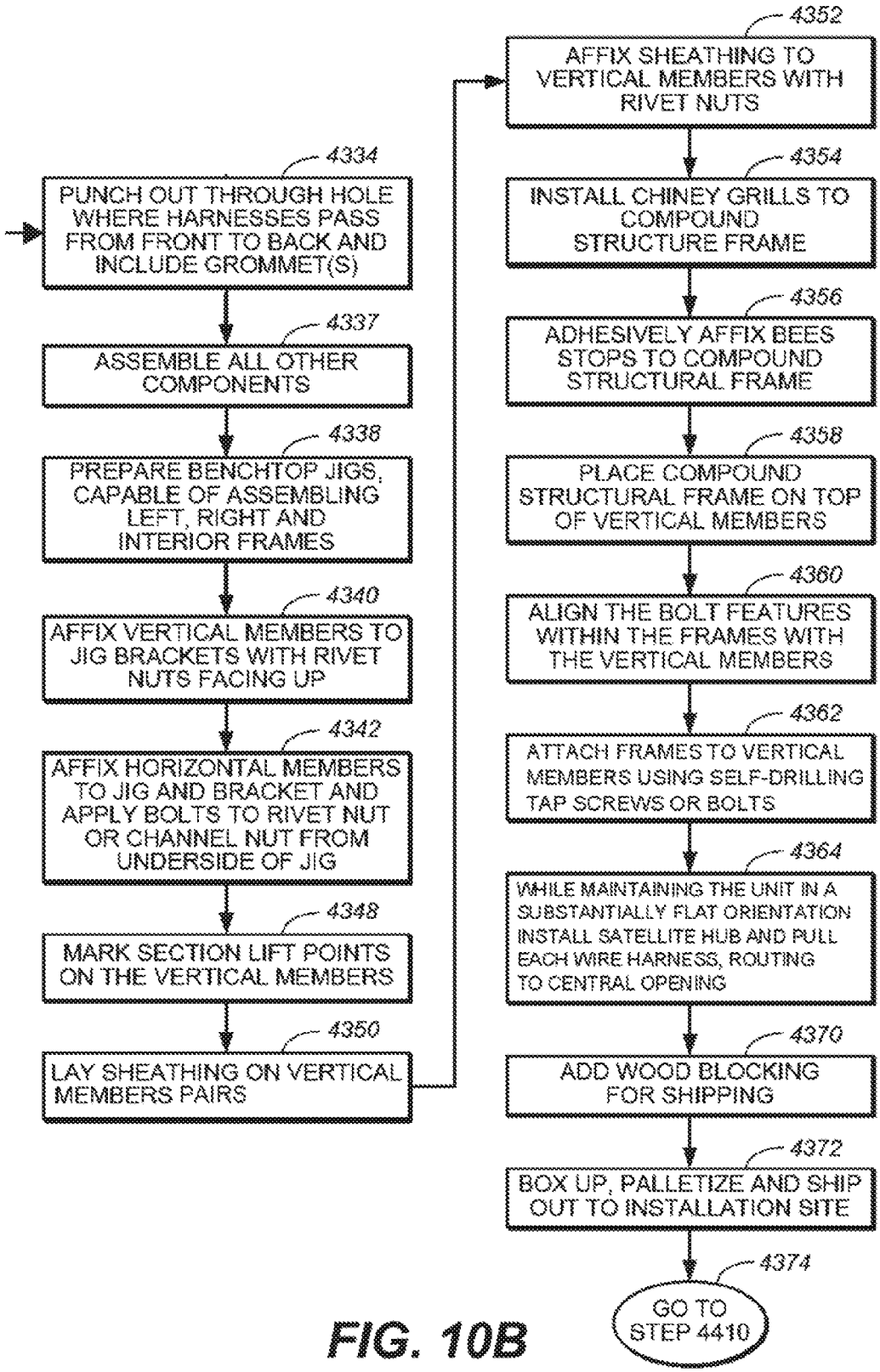
Figure 10C:
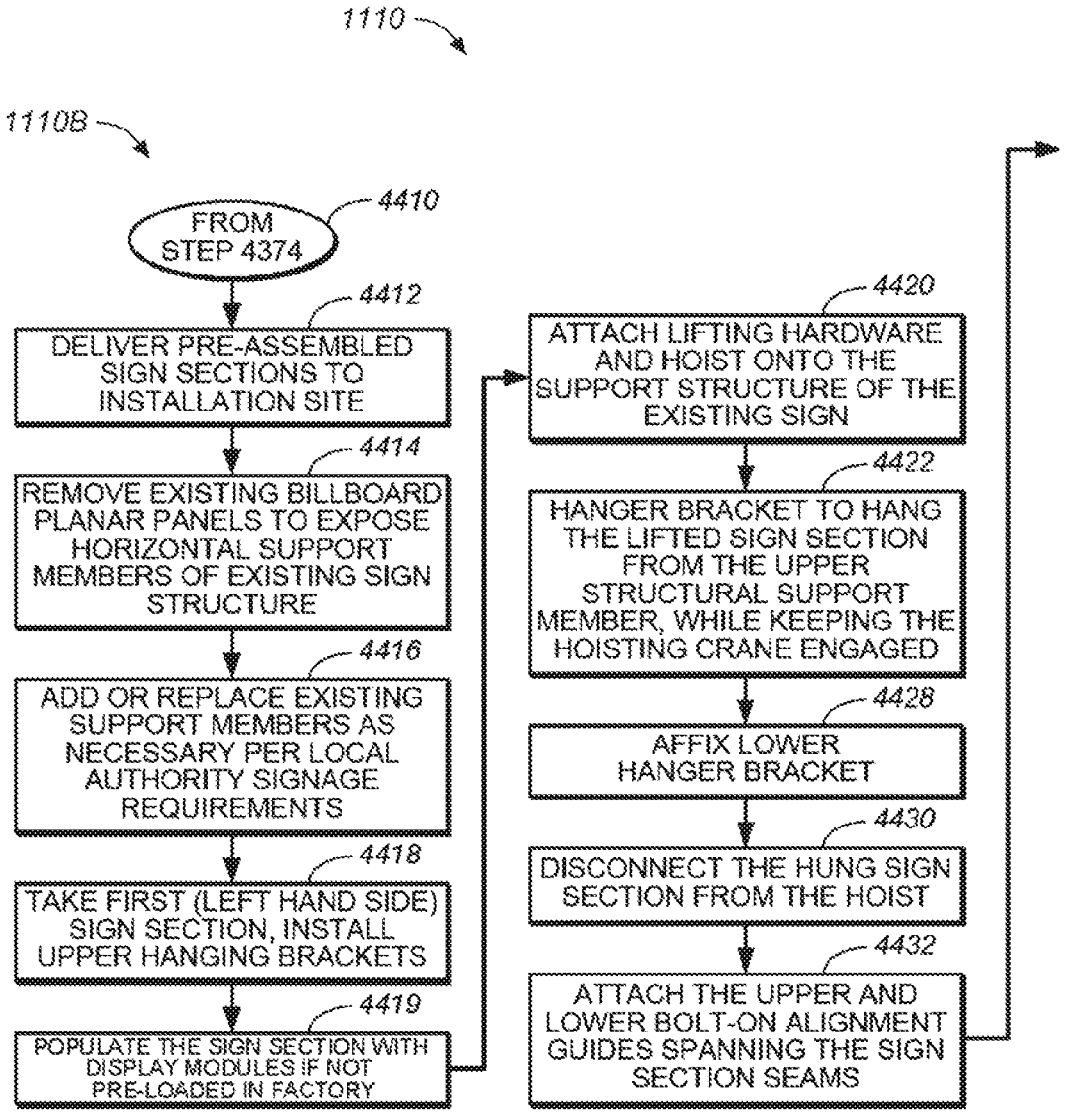

The individual ones of the sectional sign assembly units 12 utilized in the construction of the electronic sign 10 are pre-assembled in an assembly line manner. In this regard, assembly and construction takes place at a designated factory location, using a factory assembly method 1110A (FIGS. 10A-B) where assembled units are shipped to an installation site along with other component parts for the installation of the electronic sign 10. At the installation site, an installation team utilizes the unique and novel field installation method 1110B (FIGS. 10C-D) to install the assembled units to form rooftop signs, inside building signs, hung signs (i.e. hung from the underside of a signage catwalk), building wall mounted signs, or pole mounted signs, whichever the case may be. The simplicity of the design embodied in the digital electronic sign 10 of the present invention, enables a sign to be utilized in a football stadium during the football season, and then if desired, disassembled and moved to a baseball stadium and re-assembled for display presentations during the baseball season. Portability and ease of assembly and disassembly are unique and important novel features of the present invention. More particularly, a team of two people or even a single installer, with a simple hoist, a ladder, a drill, a skill saw, a hammer and a screwdriver, may quickly and easily assemble, disassemble and re-assemble the electronic sign 10 regardless of location.

Each sectional sign assembly 12 utilized in the construction of the electronic sign 10 is loaded with a plurality of like LED display modules, such as an LED display module 14 as best seen in FIG. 2. These LED display modules are more fully described in U.S. Pat. No. 9,330,583, issued on May 3, 2016, and will not be described hereafter in greater detail. It would suffice to mention, however, that each LED display module 14 includes a right-side display panel 14R and a left-side display panel 14L, each panel being provided with a plurality of light omitting diodes that are weather protected by an associated right-side louver 17R and an associated left-side louver 17L. Each respectively louver 17R, 17L is provided with a plurality of access holes or openings, such as an access hole or opening 215. The access holes 215 are dimensioned for receiving therein, a latching tool (not shown) that enables a service technician to activate display module latches associated with the individual ones of the LED display modules 14. Activation or deactivation of the display module latches, enables each display module 14 to be removably secured within the sign 10 using a front loading technique more fully described in U.S. Pat. No. 9,330,583.

Although the sectional sign assembly 12 has been described as having a two-element louver design, it is contemplated that a louver design may have a unitary construction or a multi-n-element construction. Accordingly, there is no intention of limiting the louver design of the present invention to any specific number of louver elements.

As best seen in FIGS. 8A-D, the electronic signs of the present invention may be customized to provide different types of signs for accommodating different types of application and signage mounting structures. Examples of these different types of signs will be provided, which particularly demonstrate the ease of customization that is provided by the present invention. The simplicity of the construction of the electronic sign 10 is found in the use of substantially identical pre-wired sectional sign assembly units, such as the pre-wired sectional sign assembly 12, where each assembly 12 is constructed using one or more customizable structural frames 9012 (FIG. 6) and one or more structural support structures 16 as previously mentioned. In order to promote ease in customization, each structural frame 9012 is composed of structural foam and has a unitary construction that may be cut to a desired size for a given signage application.

Figure 8A:
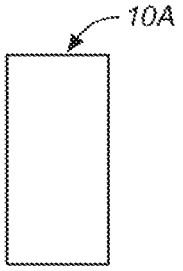
FIGS. 8A-D are schematic illustrations of different types of digital electronic signs with different sectional sign assembly unit configurations, each digital electronic sign being constructed in accordance with the present invention.
Figure 8B:
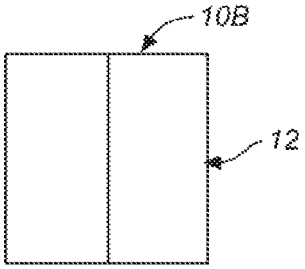
Figure 8C:
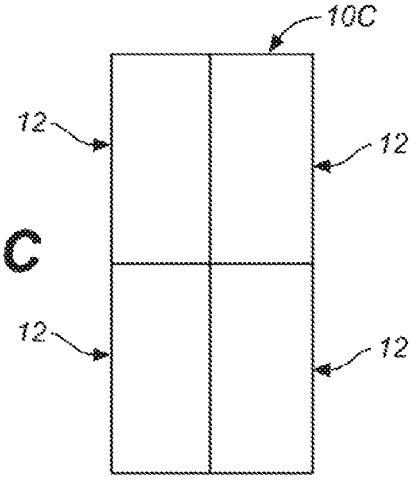
Figure 8D:
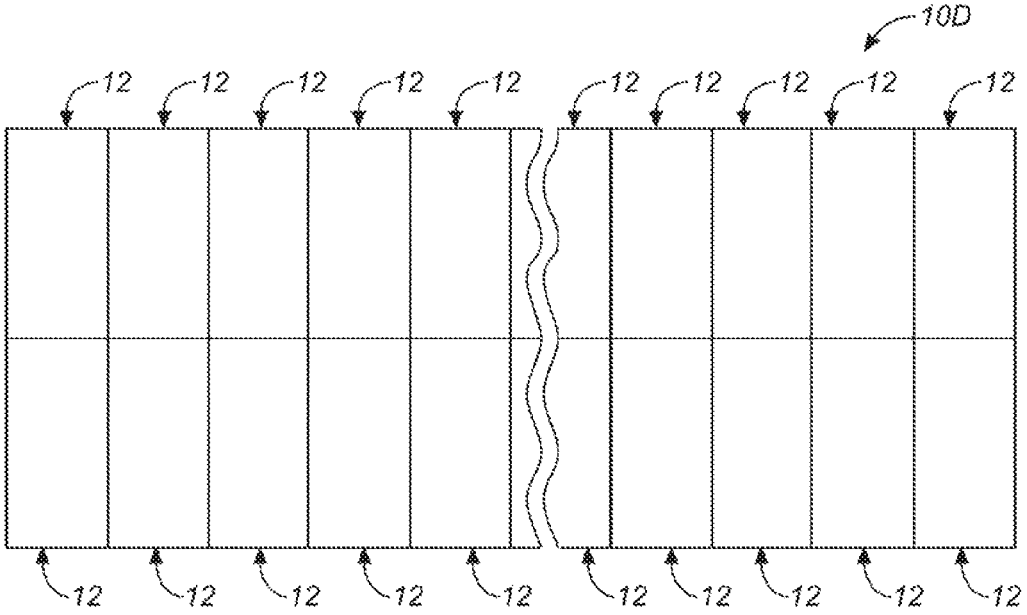

Reference may be made to FIGS. 8A-D which illustrate different constructions of the present invention:

FIG. 8A illustrates a small half poster height board sign 10A that utilizes a single column structural frame construction (5' H by 2' W) with an array of display module receiving bays for supporting five display modules therein, where the bays are configured in a M by N arrangement where M equals one and N equals five;

FIG. 8B illustrates a medium half poster height board sign 108 that utilizes a full size or double column structural frame construction (5' H by 4' W) with an array of bays for supporting ten (10) display modules therein, where the bays are configured in a M by N arrangement where M equals two and N equals five;

FIG. 8C illustrates a poster height board sign 10C that utilizes a stacked double column structural frame construction (10' H by 4' W) with an array of bays for supporting twenty (20) display modules therein, where the bays are configured in an M by N arrangement where M equals two and N equals ten such as sign construction 10C is deliverable on a low boy trailer since the assembled sign 10C does not exceed the maximum height for road transportation that would otherwise require a special transportation permit;

FIG. 8D illustrates another poster board sign 10D that utilizes a stacked structural frame construction (10' H by 30' W) with an array of bays for supporting display modules therein, where the bays are configured in a M by N arrangement. Such a sign construction 10D is deliverable on a double wide low boy trailer since the assembled sign 10D does not exceed the maximum height for road transportation that would otherwise require a special transportation permit; and A bulletin board sign (not shown) that utilizes a stacked structural frame construction of approximately 14' H by 48' W, with an array of bays for supporting hundreds of display modules therein, where the bays are configured in a M by N arrangement where M equals 48 and N equals 13. A sign of this large construction is deliverable in sections and hoisted into place on a section-by-section basis.

From the foregoing, it should be understood that the height and width of the sectional sign system of the present invention is flexible, ranging from individual sections that are only one structural bay wide (2 feet) to sections that are only one bay tall (1 foot) to larger sections as needed for the different types of sign configurations. Moreover, it should be understood that the structural frames are composed of structural foam that may be cut to allow a specific construction to be achieved. For example, providing a half frame (1 bay wide and 5 bays tall) or an additional row (1 bay wide by 1 bay tall). Because of this unique and novel modularity associated with structural frames and resulting signs, only a single example of assembly or retrofitting will be described hereinafter it being understood that the kits and methods may be modified by those skilled in the art to construct or retrofit signs of different heights and widths without departing from the true scope and spirit of the present invention.

Before describing the sectional sign assembly 12 in further detail, it may be beneficial first to briefly consider some of the many advantages that can be achieved with the present invention, as will be explained hereinafter in greater detail.

Figure 5:
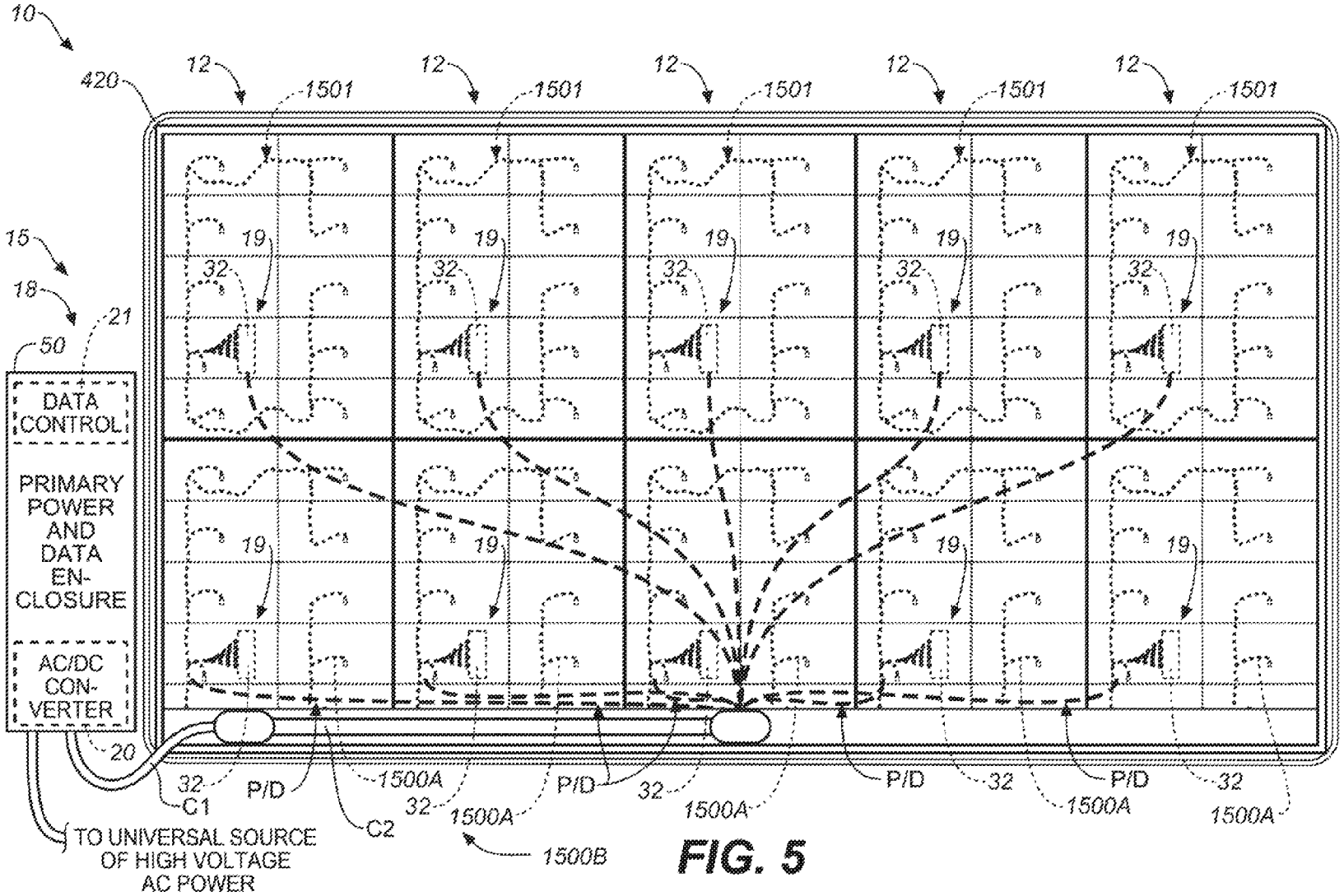
FIG. 5 is a schematic view of a power/data routing system forming part of the digital electronic sign of FIG. 1.

Firstly, the digital electronic sign 10 utilizes a power/data routing system 15, where direct current low voltage power is provided at the back-side of the electronic sign 10, as best seen schematically in FIG. 5. This low voltage direct current power is then routed to the front-side of the electronic sign 10, where it is distributed throughout each structural frame 9012 by the use of satellite power/data hubs 19 that are mounted (one per structural frame) directly within a display module receiving bay 9016 (FIG. 6). Each display module receiving bay 9016 is also configured for receiving and supporting therein a display module, such as the display module 14 (FIG. 2). Using this approach, the heat producing components of the power/data routing system 15 are separated and spaced from the satellite hubs 19, so the accumulation of heat at about the control location of a display module 14 is greatly reduced. This in turn means less component degradation, greater component life, and the ability to select components with reduced operating temperature specification requirement.

Secondly, the scheme of utilizing satellite power/data hubs 19, enables low voltage coupling to the individual display modules 14 to reside at a single point hub location within each compound structural frame 9012, and more specifically at a single point hub location that co-exists with a display module receiving bay co-occupied by one of the display modules, such as a display module 14. This constructions allows wiring to gain access through existing compound structural frame cutout features without the need of making special punch-through holes. This unique single point satellite hub arrangement provided relative to each compound frame 9012 within any given electronic sign construction 10 provides a further advantage by the utilization of standardized hub or power/data wiring harnesses, where each hub harness is provided with the same length, and wire gauge feature to facilitate ease in mechanical and electrical coupling such harnesses to an associated compound structural frame wire routing features and display module coupling features. This unique data/power routing scheme promotes user safety as all high voltage AC is to the rear of the electronic sign 10 and with only a low voltage DC being provided on the front-side of the sign at the display module level. In short, there is no need to disconnect the sign from its AC power source when removing or replacing the display modules.

Thirdly, the unique method of using a combination factory assembly and field installation kits, as will be described hereinafter in greater detail, provide a unique combination of in factory pre-assembly to minimize in field assembly. For now it will suffice to mention, that the utilization of compound structural frames 9012 with single point satellite hubs 19 facilitates ease in factory assembly, so that each pre-wired sectional sign assembly 12 may be easily and quickly assembled in the factory and then shipped to the field for final installation.

Figure 14A:
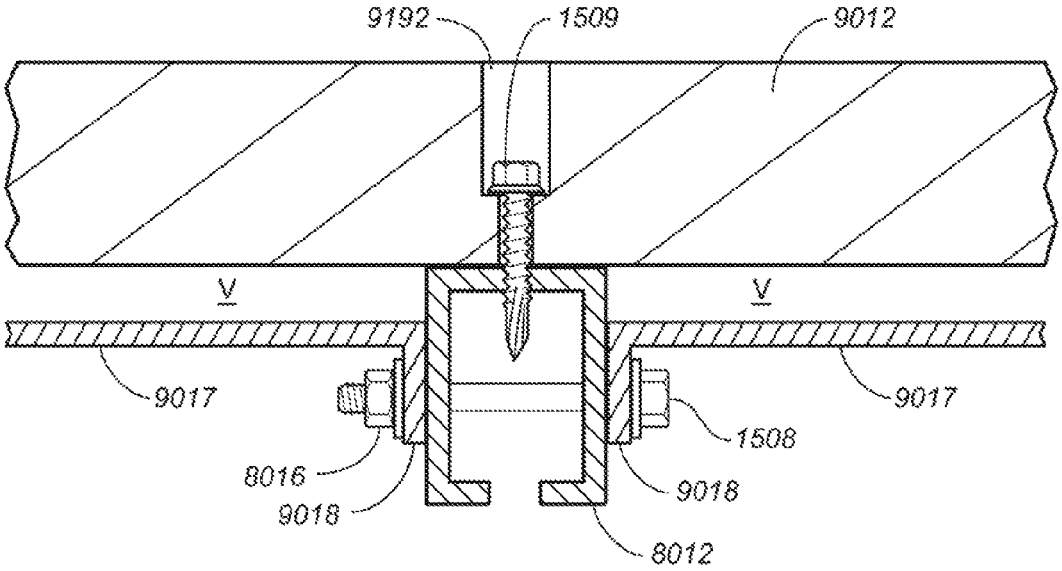
FIG. 14A is a greatly enlarged sectional view of a scheme for coupling a structural frame to a structural signage support structure to form natural air-flow chimney vents within the digital electronic sign of FIG. 1.
Figure 14B:
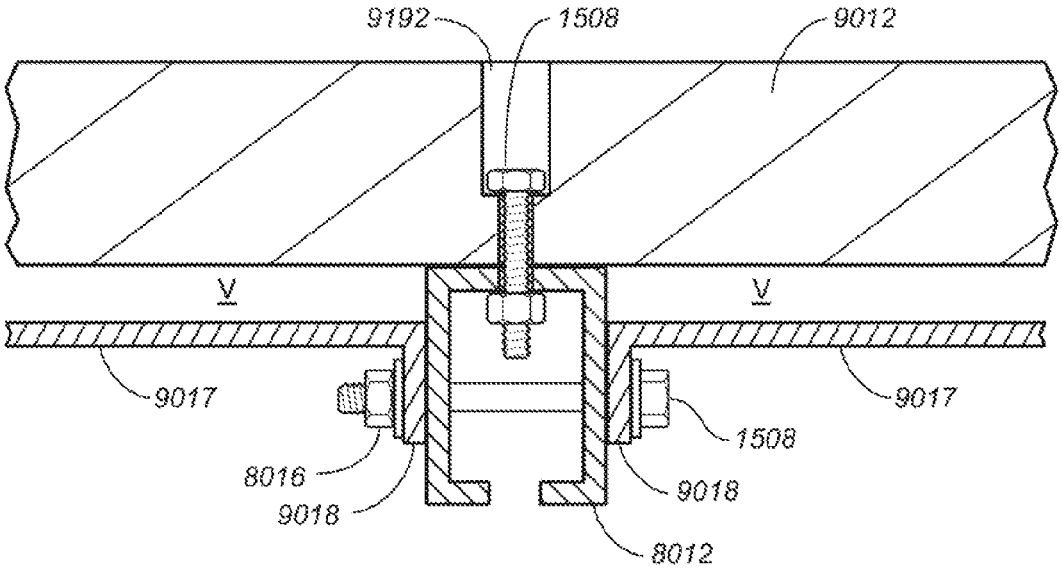
FIG. 14B is another greatly enlarged sectional view of another scheme for coupling a structural frame to a structural signage support structure to form natural air-flow chimney vents within the digital electronic sign of FIG. 1.

Fourthly, by providing structural support structures, such as the structural support structure 16, with self-drilling or tapping screws 1509 (FIG. 14A) or with rivet nuts and bolts pre-coated with Loktite® glue that are dimensioned to pass though selected ones of the existing mounting holes in a preformed compound structural frame 9012 (FIG. 14B), a compound structural frame 9012 and its associated structural signage support structure 16 can be easily and quickly be configured into assembly unit 12. This, in turn, allows for the assembly 12 to be lifted and mounted to the signage mounting structure 8 (1410). As best seen in FIG. 14A, it is also contemplated that self-drilling/tapping screws may also be employed as a securing arrangement, to completely eliminate the use of rivet nuts and bolts pre-coated with Loktite® glue greatly simplifying the assembly process. Accordingly, there is no intention of limiting the scope of the present invention to any specific form of fastening means as all forms of fastening means are fully contemplated within the true scope and spirit of the present invention.

Also, as will be described hereinafter in greater detail, by the utilization structural support structures 16, sectional sign assembly construction is easily customized. That is, by utilization of vertical structural support members, such as a vertical structural support member 8012 which are formed of rolled or sheet metal or aluminum, such vertical structural members 8012 can: (1) be easily cut to size for a given sectional sign assembly being formed; (2) be utilized to provide structural support to the resulting pre-wired assembly; and (3) be used in combination with any desired horizontal and vertical beam configurations of any signage mounting structure; thus, allowing the resulting sign structure to be more easily compliant with local sign structure regulations.

Fifthly, by forming a pre-wired assembly unit 12 with an overall depth dimension of about five (5) inches, the overall size of a sign section assembly is optimized not only for shipping and storage, but also for installation. Such a small depth dimension also greatly reduces or completely eliminates potential encroachment issues at installation sites. The following advantages are should also be derived from this small depth dimension: (1) the protrusion/z axis measurement is less than that of a poster panel vinyl product and approximately equal to that of a bulletin board vinyl sign, means no encroachment issues when retrofitting from these other types of signs to a digital sign constructed in accordance with the present invention. Such encroachment issues are common when outdoor companies purchase cabinet type products with twice or more depth dimension than that of the present invention. The small depth dimension also means there is a smaller possibility of an air space encroachment issue as well.

Sixthly, the pre-wired assembly units 12 utilized in the electronic sign 10 of the present invention have, even when stacked, such a small height, width, depth profile, that shipping to an installation site by regular truck/trailer may be accomplished without the need of special road permits and the like. Moreover, the shipped sectional products can be transported by land, sea or air without encountering any transportation size or permit issues. Traditional cabinet type outdoor signs generally require a 54' flatbed trailer to be hired in order to deliver two six feet to eight feet tall sections to an installation site. This is expensive, time consuming and typically needs to be outsourced. The present pre-wired sign 10 has height flexibility allowing sections to be formed that can be transported using conventional transportation processes without special permits.

Finally, because of the light weight associated with each sectional sign assembly unit 12, access and staging for onsite installation is greatly reduced or minimized. Thus, shipping, handling, and storage using basic winches, forklifts, pallet jacks and like equipment is all possible. In short, although heavy-lifting construction equipment is generally not required, it may be required when lifting sections with multiple sign section assemblies loaded with display modules.

Figure 12A:
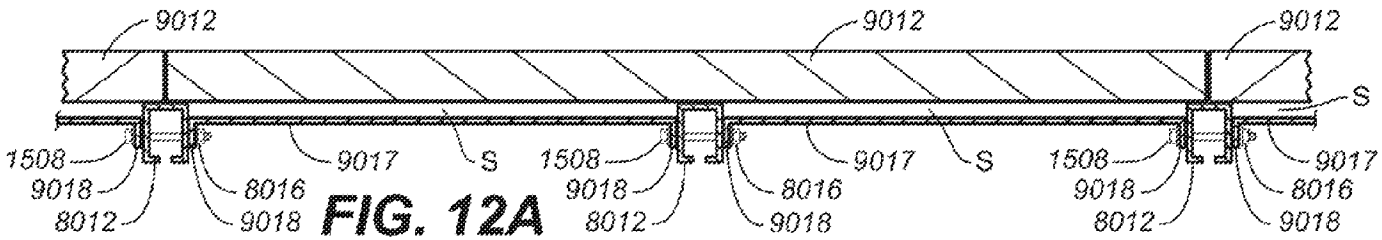
FIG. 12A is an enlarged sectional view taken from FIG. 12 along line 12A-12A.
Figure 12C:
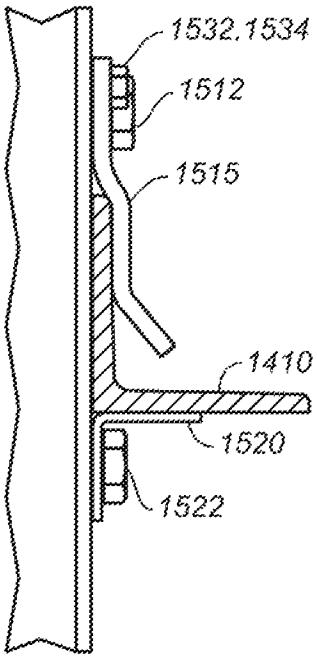
FIG. 12C is an enlarged portion of a support bracket forming part of the structural signage support structure of FIG. 12B.
Figure 12B:
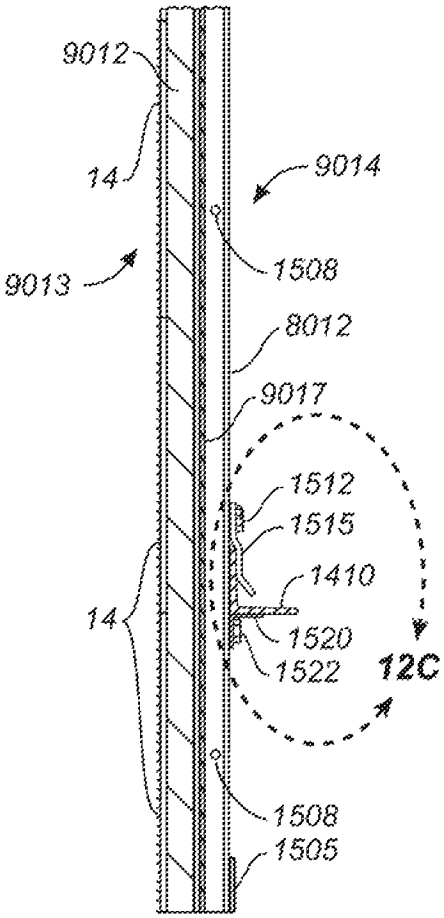
FIG. 12B is an enlarged sectional view from FIG. 12 taken along line 12B-12B.

Considering now the compound structural frame 9012 in greater detail with reference to FIGS. 6 and 12, each pre-wired sectional sign assembly 12 generally includes at least one structural support assembly 16 and at least one compound structural frame 9012. As seen in FIG. 12B, each compound structural frame 9012 has a front-facing portion 9013 and a rear-facing portion 9014. The front-facing portion 9013 of the structural frame 9012 defines an array 9030 (FIG. 6) of bay members 9016 arranged in a plurality of rows along a vertical direction indicated generally by a vertical direction line 9021 and a plurality of columns along a horizontal direction indicated generally by a horizontal direction line 9020. Each bay member 9016 is provided with a plurality of openings or cutouts, such as cutouts 9195, 9197 (FIG. 7) that greatly reduce the weight of each compound structural frame 9012 to facilitate ease of handling during assembly and installation.

Each individual bay member 9016 within the array 9030, is configured to receive and support removably therein an individual one of the weatherized display modules 14. Each bay member 9016 is also configured to receive and support therein an individual one of the satellite hubs 19, although there is only one satellite hub 19 per compound structural frame 9012 as previously described. For the particular sign configuration being considered, the individual sign section assembly unit 12 is constructed in an array which is 2 bays wide and 10 bays high, or two columns wide and 10 rows high. This configuration includes two compound structural frames 9012, where each frame 9012 is 2 bays wide and 5 bays high or a two columns wide and five rows high.

Since each structural frame 9012 is composed of structural foam, a compound structural frame 9012 may be cut to a single column of bays 9016 or a single row of bays 9016, so the structural frame 9012 size may be factory customized for any sign size configuration as needed. Moreover since the compound structural frames 9012 may be dovetailed joined together from left to right, using male and female dovetail features 9194M and 9194F or from bottom to top using male and female dovetail features 9196M and 9196F, a variety of different sign configurations are made possible. So the sign examples described herein (FIGS. 8A-D) are merely a few examples of different configurations and not intended to be any form of limitation.

Considering now the power/data routing system 15 in greater detail with reference to FIG. 5, the power/data routing system 15 generally includes a single primary power/data hub 18 and a plurality of satellite power/data hubs 19 (one per each compound structural frame 9016). The primary power/data hub 18 generally includes a power converter system 20 and a data control system 21. The power converter system 20 is interposed between a source of universal high voltage alternating current and one or more pre-wired sectional sign assembly units 12. The power converter system 20 is a conventional AC to DC power converter that transforms universal high voltage alternating current, such as 120 VAC, into a source of low voltage direct current, such as 28 VDC which can then be utilized by the individual ones of the display modules 14. As such AC to DC power converters are well known to those skilled in the art, the power converter system 20, will not be described hereinafter in any greater detail.

As best seen in FIG. 5, the power converter system 20 and the data control system 21 are both mounted within a power and data enclosure 50 that is mounted proximate to the signage mounting structure 8 (1410). In this regard, it may be mounted directly on the signage mounting structure 1410 as best seen in FIG. 1, or it may be mounted at any other location at or near the signage mounting structure 8 as diagrammatically illustrated in FIG. 5. It will suffice, to mention that regardless of the mounting location of the enclosure 50, weatherized conduit, such as weatherized flexible conduit C1 and hard conduit C2, as best seen in FIG. 5, may be utilized in routing power and data from the primary power/data hub 18 to a convenient transition area at the back-side of the electronic sign 10, where power and data, may then be coupled from the back-side of a convenient one of the sectional sign assembly units to a front-side of such a sectional sign assembly unit for distribution to the individual ones of the display modules 14 mounted to the front-side of the electronic sign 10.

The data control system 21 is a conventional data control system which may be a hard-wired or a wireless system for receiving and transmitting data for use by the individual ones of the display modules 14. As such data control systems are well known to those skilled in the art, the data control system 21, will not be described hereinafter in any greater detail.

Although in the descriptions that follow, reference will be made to a hard-wired power/data distribution scheme, there is no intention of limiting the disclosed invention to hard-wired data distribution scheme, as wireless data distribution schemes are fully contemplated within the true scope and spirit of the present invention.

In order to effect greater efficiency in field installation and retrofitting of existing static signs (or even older electronic signs with display module plug-in to foundational support capabilities), much of the electronic sign 10 is factory pre-assembled in one or more sectional sign assembly units, such as the pre-wired sectional sign assembly 12. In this regard, the present invention not only contemplates installing a completely new sign inclusive of a signage mounting structure 8, but also contemplates retrofitting either static signs or older electronic signs using the assembly or retrofit kit 1210 (FIG. 9) in combination with the method of using these kits 1110, as best seen in FIG. 10. For now, it will suffice to mention that the field assembly kit portion 1210B for construction of the electronic sign 10 (FIG. 1) generally includes a plurality 1212 of substantially identical pre-wired sectional sign assemblies 12 that are either pre-loaded with display modules or that are field ready to be loaded with display modules, and then mechanically coupled to a foundational support frame, post, poster board or signage support pole, whichever the case may be. In any event, although individual sign section assembly units 12 may be shipped from the factory without being loaded with display modules 14, it is fully contemplated that such assembly 12 may also be shipped fully loaded with display modules 14 to help further reduce field installation time. In this regard, when the sectional sign assembly unit 12 is mentioned hereinafter, it is to be understood that for clarity of showing certain features of the assembly 12, such as wiring harnesses for example, the assembly 12 may be shown with or without display modules, and with or without other field installed components, such as mounting hardware.

It should also be mentioned, that although it was stated that the field assembly kit 1210B generally includes a plurality 1212 of substantially identical pre-wired sectional sign assemblies, such as the assembly 12, variations in manufacturing processes contemplate different types of construction without departing from the true scope and spirit of the present invention. For example a sheathing material utilized in the construction of the coupling structure 16 associated with the sectional sign assembly 12, may be flat sheathing or rolled sheathing. Moreover, different types of fasteners (bolts/nuts, self-drilling/tapping screws, and the like) as well as different types of mounting hardware may be employed. Such variations as these may or may not be mentioned hereinafter in greater detail as it is appreciated that those skilled in the art of electronic signs will have a good understanding of which types of fasteners or which types of mounting hardware will best suit an installation situation.

Figure 4:
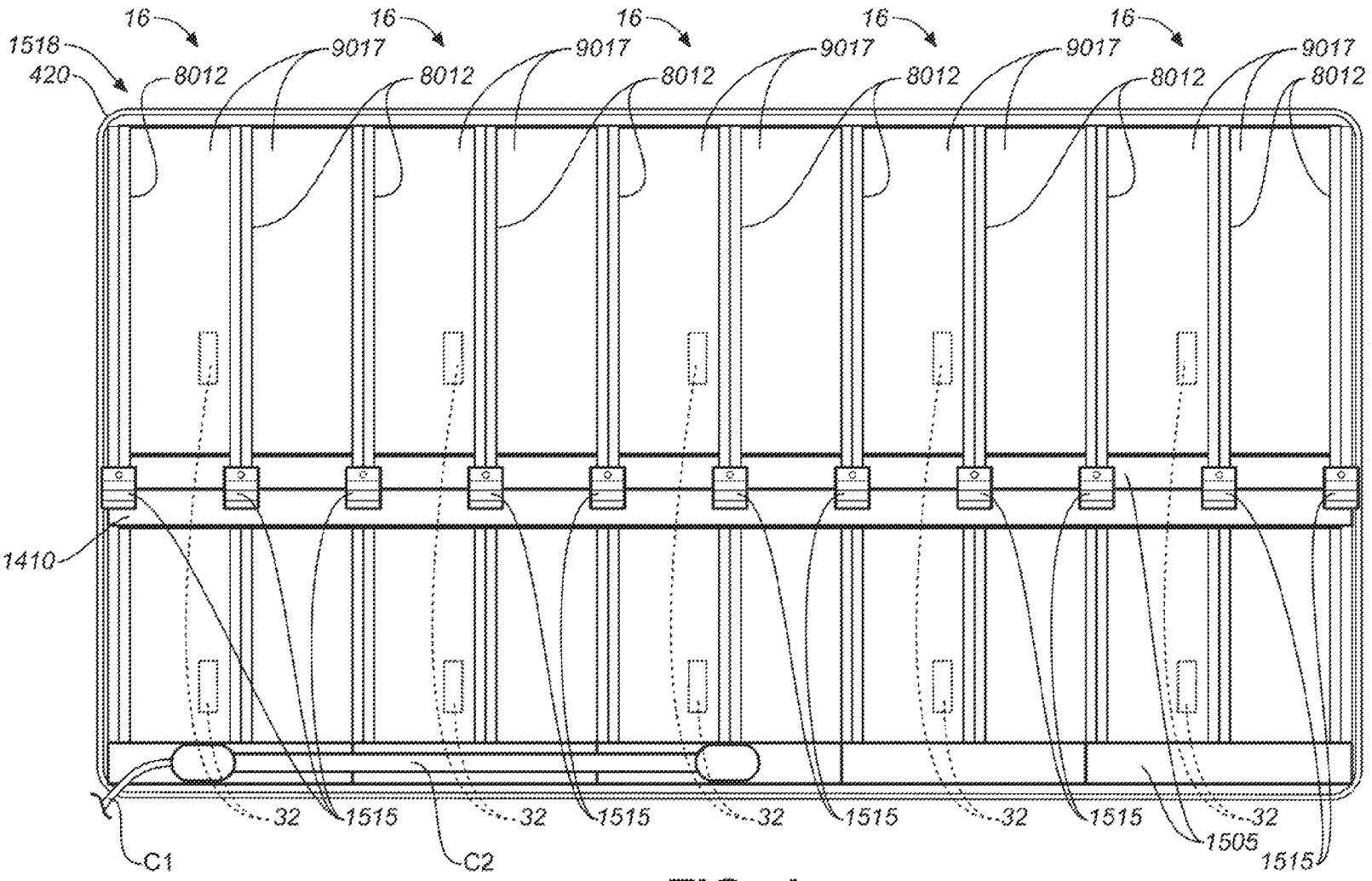
FIG. 4 is a schematic rear elevational view of the digital electronic sign of FIG. 1, illustrating a plurality of structural signage support structures forming part of the digital electronic sign of FIG. 1.
Figure 7:
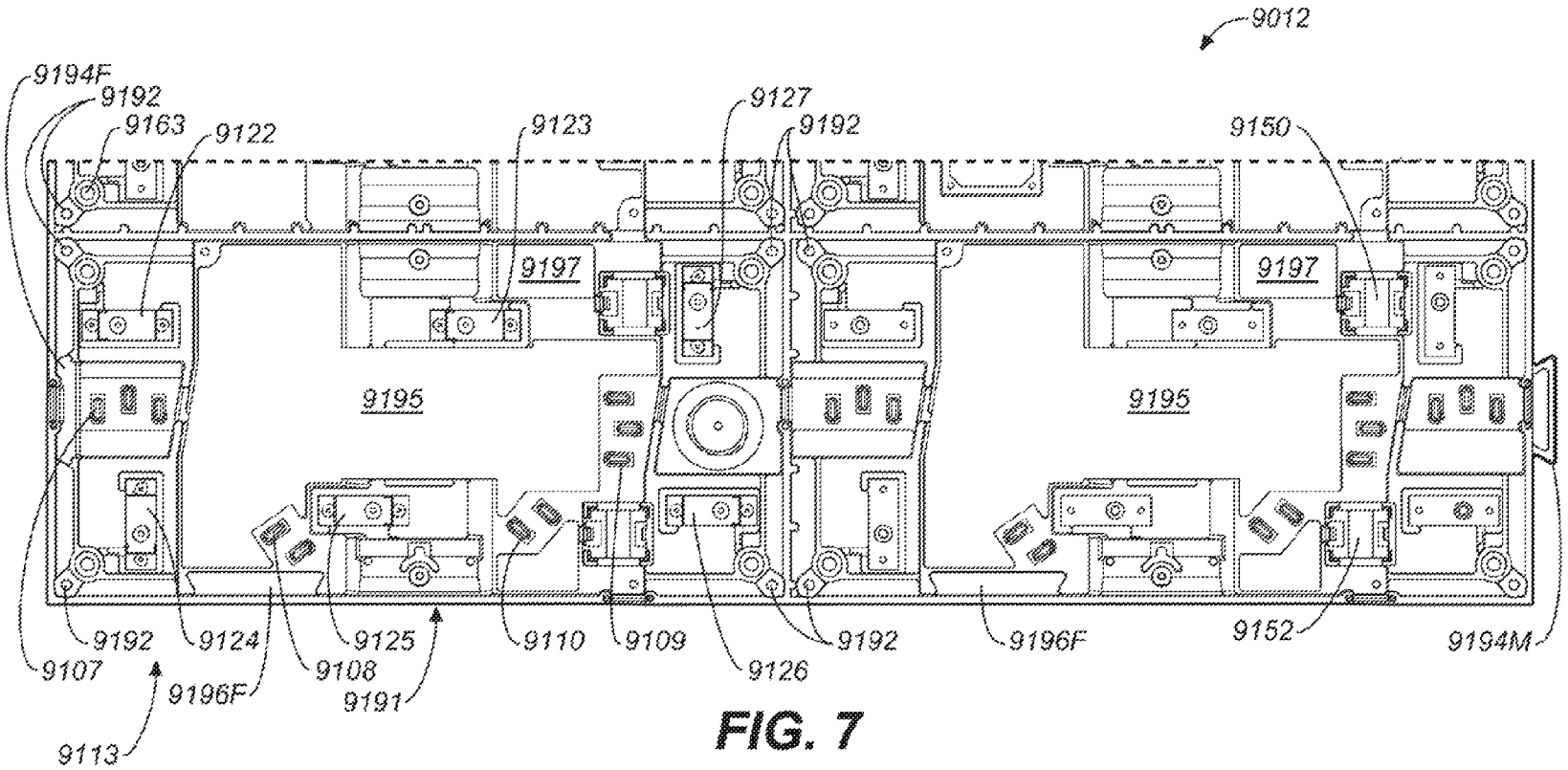
FIG. 7 is an enlarged front plane view illustrating a portion of a structural frame forming part of the pre-wired sectional sign assembly unit of FIG. 6.
Figure 11:
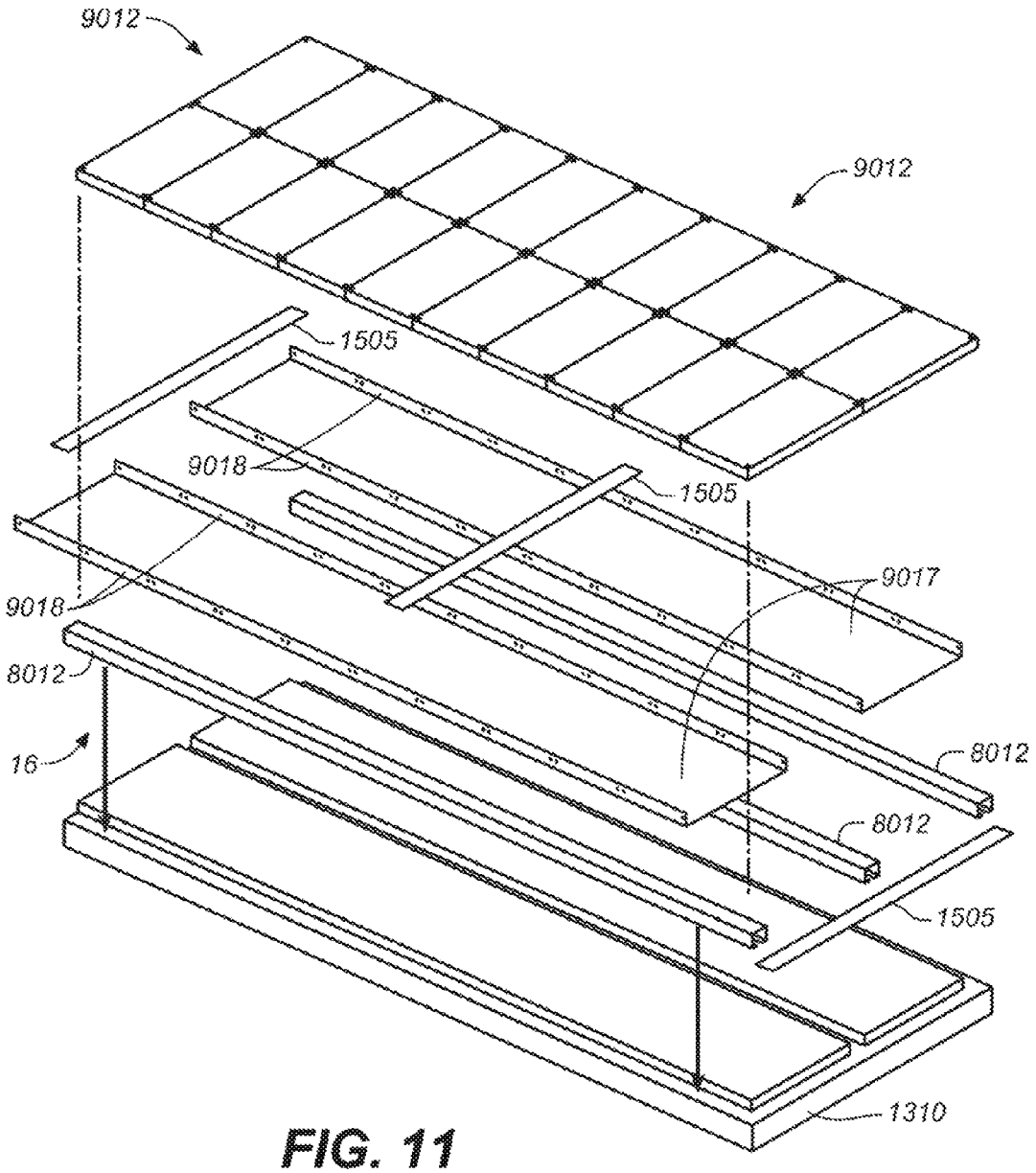
FIG. 11, is a diagrammatic view of a factory workbench assembly jig with an exploded view of various component parts of a sectional sign assembly unit forming part of the digital electronic sign of FIG. 1.

Considering now the factory assembly kit 1210A in greater detail with reference to FIG. 9A, the factory assembly kit generally includes (1) a plurality 9022 of vertical structural support members 8012 (FIG. 11); (2) a plurality 9024 of vertical structural support member bolts 1508 with dry Loktite® coated thereon and associated rivet nuts 8016 (FIG. 12A); (3) a plurality 9026 of compound structural frames, such as a structural frame 9012 (FIGS. 6-7); (4) a plurality 9028 of sheathing members, such as a sheathing member 9017 (FIGS. 4 and 11); (5) component parts 9032 for the assembly of a power and data distribution kit including the primary power/data distribution hub 18; a plurality of power/data satellite hubs 19; (6) component parts 9034 for the assembly of a plurality of display modules, such as a display module 14; and (7) various other component parts 9036 for providing signage mounting and installation processes including various miscellaneous tools and self-drilling screws 1509 (FIG. 14A).

The vertical support members in the factory assembly kit 1210A come in standard lengths which, if necessary, may be cut to a customized size at the factory during method 1110A, to form individual vertical support members, such as the vertical support member 8012. If customization is not required, this step may be eliminated by utilization of vendor supplied standard length vertical support members. Each support member 8012 utilized in a sectional sign assembly 12 is provided to give rigidity to the compound structural frame 9012 and to facilitate mounting the assembly 12 to a signage mounting structure 1410 for example. These support member pairs, as best seen in FIG. 11, are also provided as mounting surfaces for the sheathing 9017. In this regard, when the sheathing 9017 is secured between support member pairs, as best seen in FIG. 12A, and when the support member pairs are secured to the rear-facing portion of the compound structural frame 9012, the sheathing 9017 will be spaced from the rear-side of the compound structural frame 9012. This spacing relationship is an important feature of the present invention as will be described hereinafter in greater detail.

Different types and kinds of support members are contemplated by the present invention, including but not limited to channel support members, and U-shaped support members to mention but a few examples. There is no intention therefore of limiting the scope of the present invention to any particular type or kind of support member so long as the support member has sufficient rigidity to support a sign sectional assembly unit 12 to an existing sign structure 8 as best seen in FIG. 1 and is capable of having sheathing and structural frames 9012 mounted thereto in a planar like arrangement (FIG. 12A).

The sheathing members 9017, as best seen in FIG. 11, are lightweight and are provided to keep the rear-facing portion of an associated structural frame free of small insects and the like and to also facilitate establishing a chimney draft effect at the back-side of the structural frames. As a plurality of the individual ones of the sign section assemblies 12 will be utilized in providing a particular type of sign structure and these sign section assemblies can be disposed in different orientations relative to one another; and different types and kinds of support members may be utilized.

Figure 13A:
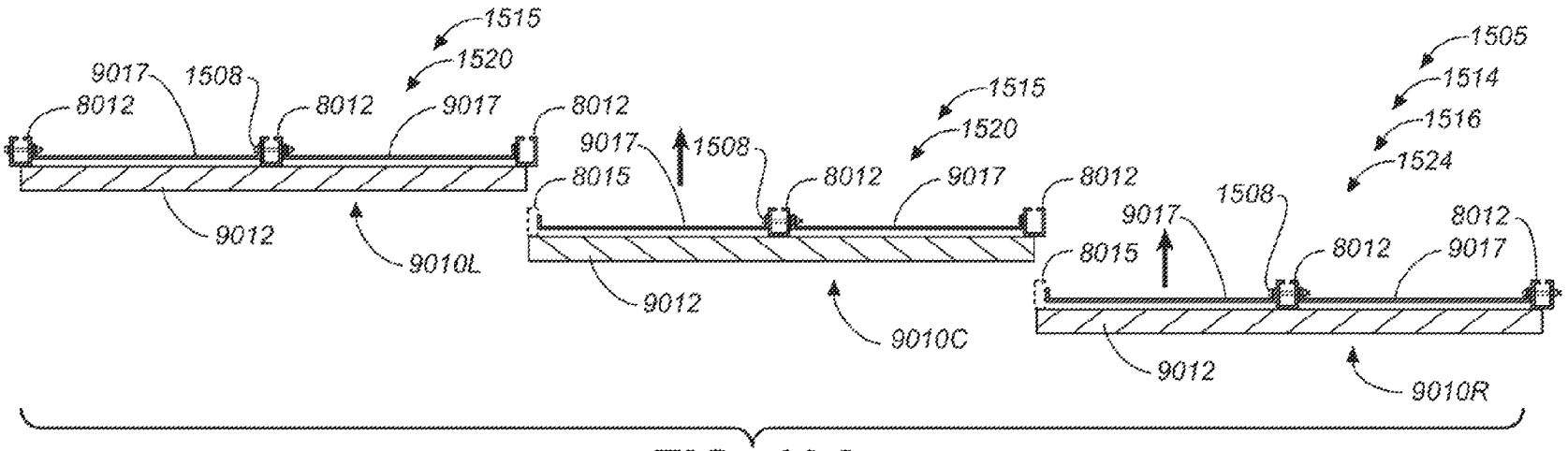
FIG. 13A is a schematic illustration of individual sectional sign assemblies in the process of being inter-connected to form a digital electronic sign with three sectional sign assembly units.
Figure 13B:
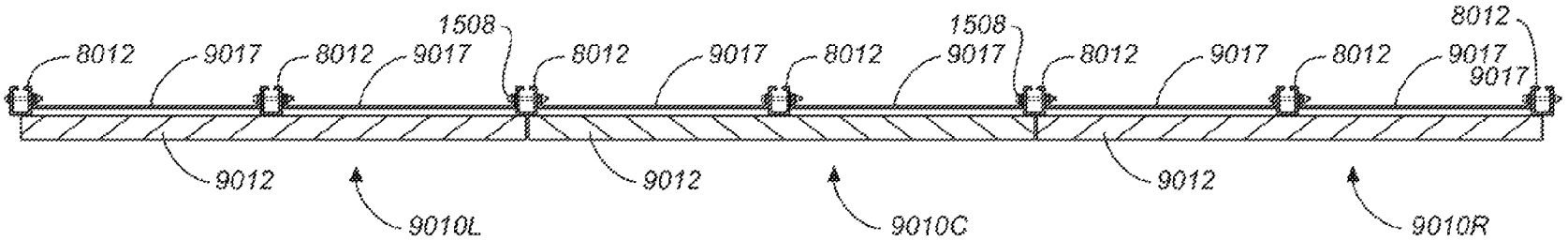
FIG. 13B is a schematic illustration of the individual sectional sign assemblies of FIG. 13A, disposed in their interconnected positions.

Considering now the inter-connection of the sign section assembly units utilized in the construction of a sign in greater detail with reference to FIGS. 13A-B, the sign section assemblies, such as a sign section assembly 9010 L, a sign section assembly 9010C, and a sign section assembly 9010R are constructed to facilitate stacking and to facilitate their mounting in a left to right type of configuration. More particularly, as best seen in FIG. 13A, the left most assembly 9010L is provided with three structural support members 8012 arranged from left to right on the frame 9012 slightly overlapping the left boundary edge of the frame 9012, at the center of the frame 9012 and slightly overlapping the right boundary edge of the frame 9012. The overlapping configuration is provided so that the right most support member frame 9012 can be affixed to both the left most section 9010L and to the left boundary edge of the internal section 9010C or the left boundary edge of the right most section 9010R, whichever the case may be relative to what type of signage is being modified or constructed.

The center or internal sections 9010C are provided with only two support members 8012, one at the rear-side center of the associated frame 9012 and one slightly overlapping the right boundary edge of the frame 9012. This overlapping configuration is provided so the right most support 8012 of the internal section 9010C can be affixed to a right most section 9010R.

The right most sections 9010R are also provided with only two structural support members 8012, one at the rear-side center of the associated frame 9012 and one at the extreme right boundary edge of the frame 9012. For the purpose of shipping and hoisting, wooden blocks, such as a wooden block 8015 is temporarily secured to the yet to be secured sheathing 9017 in this assembly. From the foregoing, it should be understood that sign section assemblies 9010L, 9010C and 9010R are hoisted and hung onto an existing sign support structure utilizing a left to right mounting configuration. It should also be understood, that this left to right procedure would be repeated if needed to form an array of sign sections on an existing sign support structure.

Considering now the satellite hub 19 in greater detail with reference to FIGS. 5-6, the satellite hub 19 generally includes a condensed extender enclosure 32 that is provided with a set of module harness connections for helping to coupling power and data to the individual display modules disposed within an associated structural frame 9012. In this regard, power and data wires are coupled from the primary hub 18 to each satellite hub 19 and then from the satellite hub 19 to the individual display modules 14 using standardized satellite hub harnesses, such as a satellite hub harness 1501 as best seen in FIG. 5.

During factory assembly, each structural frame 9012 has mounted therein, in a specifically designated one of the display module receiving bays integrally formed within the frame 9012, the condensed extender enclosure 32. On an input side of the condensed extender enclosure 32 there is a pair of power wires and a multi-conductor, standard CAT5e Ethemet cable, indicated generally as P/D in FIG. 5. A FPGA-based microprocessor and other circuits (not shown) are provided within the enclosure 32 to couple power and to process incoming data and for sending video and command data to the individual display modules 14 associated the condensed extender enclosure satellite hub 19. More particularly, the output side of each condensed extender enclosure 32 is provided with a hub harness 1501 that includes a plurality of power/data extensions, indicated generally at 1500A. The power/data extensions 1500A are coupled between a PCBA (not shown) mounted within the enclosure 32 and the individual display modules 14 associated with the satellite hub 19. The individual ones of the power and data wiring extensions 1500A are of pre-determined standardized lengths such that each extension is selected to terminate in an individual one of the display module receiving bays 9016 (FIG. 6) in the associated structural frame 9012. Each extension 1500A terminates in a display module connector plug 1502. Each display module connector pub 1502 is configured to be connected to a complementary display module connector plug (not shown), disposed on a display module. This plug to plug arrangement enables quick and easy inter-connections between a display module 14 and an associated satellite hub 19.

The power/data wiring extensions 1500A are routed and secured to the structural frame 9012 using the integrally formed wire routing features of the frame, such as wire routing features 9107-9109 as best seen in FIGS. 6-7. A space S (FIG. 12A) is formed as vertical structural beams 8012 are mounted to their associated structural frame 9012. This space S is formed between the sheathing 9017 and the back-side of the structural frame 9012. Power and data wires P/D from the primary power/data hub 18 may be routed in this space S to respective ones of the satellite hub 19. Such power/data wires P/D can be passed from the back-side of a frame 9012 to the front-side of a frame 9012 using a cutout area within the frame, such as the cutout area 9197.

In order to secure the satellite hub 19 within the cutout area 9195 of the designated display module receiving bay 9016, each condensed extender enclosure 32 is provided with a pair of spaced apart enclosure mounting tabs T, with mounting screws as best seen in FIG. 6. The mounting tabs T and their associated mounting screws enable the enclosure 32 to be mounted within the designated one of the display module receiving bays 9016. In this regard, the enclosure 32 is dimensioned to be received within the cutout area 9195 and is configured so that it does not interfere with a display module 14 that is mounted within the same display module receiving bay. In short, both the enclosure 32 and a module 14 may be accommodated within a single display module receiving bay 9016.

The power/data routing system 15 is provided by a power/data distribution kit 1500 which includes at least one satellite hub 19, sometimes referred to hereinafter from time to time as a first or satellite part 19, and the primary hub 18, sometimes referred to hereinafter from time to time as a second or primary part 18. The first part 19 is provided with the enclosure 32 which has extending therefrom the hub harness 1501 with a plurality of power/data extensions 1500A (FIGS. 5-6). When installed in a compound structural frame 9012, the satellite hub 19 forms a component part of the pre-wired sign sectional assembly 12. The second part 18 (FIG. 5) of the power/data routing system 15 ships separate from the sign sectional assembly units 12, since the second part 18 must be mounted proximate to the signage mounting structure 8 at the installation site. The power/data distribution kit 1500 is partially utilized in the factory to help form individual sign section assemblies, such as the assembly 12 (9010L, 9010C, and 9010R) and partially utilized in the field at the installation site to install primary power/data hub 18 proximate to the sign under construction.

The following is intended to help clarify how the two parts 18 and 19 are utilized in helping to modify a sign structure, using its structural support features, such as a support feature 1410. Each first part 19, which is a pre-wired portion, is associated with and made part of the pre-wired sign sectional assembly 12 as best seen in FIG. 6. In this regard, each first part 19 includes a plurality of power extensions ends 1502 for coupling a DC power source to the plurality of display modules 14 populating the bay members 1916 of a compound structural frame 9012. Each first part 19 further includes a power/data junction end for coupling the power/data extension end P/D of the second part 18 to the first part 19.

The second part 18, also forms part of the power/data routing system 15, which second part 18 is configured to be coupled between a main AC power source and the AC/DC converter 20 and the data control unit 21. This power/data routing system 15 is inclusive of at least one DC/data SF hub 19 associated with each structural frame 9012 forming part of the sectional sign assembly 12. In this regard, as best seen in FIGS. 5-6, each satellite DC/data SF hub 19 is mounted within a structural frame 9012 display module receiving bay 9016 to enable power to be distributed outwardly therefrom to each of the bays 9016 within the associated compound structural frame 9012. Since two compound structural frame units 9012 are associated with the pre-wired sign section 12, as best seen in FIG. 6, two DC/data SF hubs 19 are provided.

It should be noted that each first part 19 is substantially identical, utilizing cable or wire with a sufficiently small wire gauge that allows ten harnesses or cables to pass throughout a structural frame 9012. In a like manner, the second part 18 also utilizes cable or wire with a sufficiently small wire gauge to allow all the necessary delivery and return low voltage wires and data cables to be distributed throughout the sign 10 and more particularly through cut-outs, such as cutout 9197 within an associated compound structural frame 9012. For example, the cutout 9197 has a sufficient space opening for allowing such a bundle of power/data cables P/D to pass there through from the front-facing portion 9013 to the rear-facing portion 9014 of the frame 9012 and then, through a sheathing cutout (not shown) to engage power and data connectors disposed within the associated satellite hub enclosure 32 for further routing and distribution to the individual ones of the display module receiving bays for use by the display modules when loaded and latched within those bays. If needed, a cable or harness restraint (not shown) may be mounted in an appropriate resistant position, such as on an adjacent wire routing feature, such as the wire routing feature 9107 and 9109 to provide an power/data introduction point on the front-facing portion of the structural frame 9012.

These satellite hubs 19 and their associated hub harnesses 1501 are all factory installed, where such hub to structural frame installation is accomplished by utilization of the different portions of the sectional sign assembly and installation kit 1210; namely, the factory assembly portion 1210A (FIG. 9A) and the field installation assembly portion 1210B (FIG. 9B). Accordingly, since satellite to frame installation is accomplished in the factory, field installation and retrofit time is greatly reduced.

Considering now the sectional sign assembly and installation kit 1210 and method of using 1110 the kit 1210 to assembly and install the electronic sign or 10 in greater detail with reference to FIG. 10, the factory assembly method 1110A (FIG. 10A), is initiated at a start step 4310 where the process proceeds to an optional cutting operation step 4312. At the cutting step 4312 individual ones of the vertical support or channel members 8012 are cut, if necessary, to customized sizes a sign under construction. If a standardized sign is under construction, the channel member 8012 are pre-cut to desired sizes and this step 4312 may be omitted Horizontal support members 1505 (FIG. 11), if utilized, are also cut to size at this cutting step 4312 relative to customization; otherwise the horizontal support members are also provided in standard lengths and do not require cutting, thereby eliminating the need for this optional cutting step 4312.

Once the channel members 8012 are ready, the process proceeds to an install step 4314 where rivet nuts 8016 are installed at desired location corresponding to a particular structural bolt pattern. The process then goes to another install step 4316 where a minimum of one rivet nut 8016 per vertical support member 8012 is installed to facilitate attaching the sheathing backing 9017 between pairs of the vertical support or channel members 8012.

Next in the assembly process 1110A, another operation step 4318 is performed where horizontal reference lines (not shown) are marked out across the vertical support members 8012. The horizontal reference lines are provided as reference line to affix hanger brackets to the back-side of the assembly 12.

After the reference lines are marked out on the support members 8012 at step 4318, the process goes to a cutting step 4320, where sheathing material is cut to size to provide the required sheathing for a structural frame 9012. The sheathing 9017 is then further processed at an action step 4322 where holes are punched out in the sheathing at required rivet nut locations. These hole are oversized holes to fit over a rivet nut flange associated with a nut 8016.

Next, the process goes to another action step 4330 where mounting holes are provided in the sheathing. These mounting holes help facilitate the mounting or attaching of the sheathing to the sidewall surfaces of the vertical support members 8012.

From step 4330, the process goes to an action/install step 4334 where a harness access hole is punched out in the horizontal beams 1505 at those locations where the low voltage power and data wiring harnesses from the primary hub 18 passes from the back-side of a coupling structure 16 to the front-side of the coupling structure 16 for further routing to each individual one of the satellite hubs 19 as best seen in FIG. 5. In order to protect the power and data wiring harnesses from the formed edges, a grommet (not shown) is installed in the resulting hole.

The process then advances to an assemble step 4337, where all other components needed for the sign section assembly 9010 are assembled. From the foregoing, it should be understood that those components required for the sign section assembly 9010 are not available for a continued manufacturing process. In this regard, the process proceeds to a prepare step 4338.

At the prepare step 4338, a bench top jig 1310 (FIG. 11) which is capable of assembling left side assemblies, right side assemblies and center assemblies is prepared for the continued manufacturing process. Once the jig 1310 is prepare at the jig preparation step 4338, the process goes to an affix step 4340 where the vertical members required for the particular type of sign section assembly (left, right or interior assembly) are affixed to the jig 1310 with the rivet nuts 8016 facing upward from the bench top.

From the affix step 4340, the process continues to another affix step 4342 where top and bottom horizontal support members 1505 are affixed between vertical support members. These horizontal support members 1505 are mostly decorative in nature and vary in size depending upon the type of sign being constructed.

Next, at a marking step 4348, section lift points are marked on the vertical support members 8012 as well as the horizontal support members 1505. After the marking has been applied, the process advances. It should be understood that once the horizontal and vertical support members have been fixed within the jig 1310, marking of the support members may be immediately commenced.

The process then advances to an install step 4350 where the sized sheathing is laid between pairs of the vertical support members 8012 and secured to their opposing side-walls surfaces. It should be understood by those skilled in the art that in order for the sheathing 9017 to be mounted between pairs of the vertical support member and space from any associated structural frame, the sheathing 9017 is formed with side-walls with pre-punched holes to facilitate mounting the sheeting between opposing sidewall surfaces of the associated vertical support members as best seen in FIG. 11.

Once the sheathing has been placed on the vertical support members, the process goes to an affix step 4352 where the sheathing is affixed to the vertical members with bolts 1500 and rivet nuts 8016. From the affix step 4352, the process advances to a chimney install step 4354.

At the chimney install step 4354, chimney grills are inserted into their grill locations in the compound structural frame 9012. Continuing to an install bee stop step 4356, bee stops are adhesively affixed in their respective locations within the compound structural frame 9012 in accordance with the type of sign section assembly being formed.

From the affix bee stops step 4356, the process continues to an arrangement step 4358, where the compound structural frame 9012 is placed on top of the vertical channel members 8012 of the coupling structure 16. At step 4360 the mounting bolt features 9192 within the compound structural frame 9012 are aligned with the vertical support or channel members 8012 so that self-drilling tap screws 1509 or bolts 1508 may be set into the associated mounting bolt features and then drilled into the frame mounting surfaces of the vertical support members 8012 once the frame 9012 is secured to the channels 8012, the frame 9012 and the coupling structure 16 cooperate to form chimney vents between the associated coupling structures 16 and the associated compound structural frame 9012 as seen at an install step 4362.

Next, the process continues to an install satellite hub 19 and wire harness routing step 4364. At step 4364, while maintaining the unit in a substantially flat orientation relative to the bench top the satellite hub 19 is install in the compound structural frame 9012, where the display module power/data cables are routed to the individual ones of the display module receiving bays 9016 using the wire routing features 9107-9110 integrally formed within the compound structural frame 9012. Wire harness zipper ties (not shown) are utilized to secure the free ends of the extension cables and their associated display module connector plugs 1502 to be in close proximity for coupling to a complementary display module connector forming part of a display module, such as the display module 14.

At prepare for shipping step 4370, wood blocking 8015 (FIG. 13) is added for helping to protect the assembly during shipping. Next at a final preparation step 4372, the assemblies are boxed up, palletized and shipped out to an installation site. The factory assembly process then ends at a go to step 4374 with the process advancing to a go to field installation site step 4410 (FIG. 10C) where a field installation method or process 1110B is initiated that will be described hereinafter in greater detail.

Considering now the electronic sign 10 in greater detail with reference to FIG. 98, the field assembly or kit portion 1210B of the sectional sign assembly and installation kit 1210 generally includes a plurality 1212 of pre-wired sign sectional assembly units 12 (9012), where each section is two feet wide and ten feet tail. With this type of sign structure, the sign 10 will include a plurality of sign section assemblies including a single right side unit 9010R, a single left side unit 9010L and a set of three internal units 9010C. The field modification kit 1210B also includes a plurality 1214 of display modules 14 to populate the pre-wired sign section assembly units; and a coupling assembly 1216 that includes a power/data distribution kit 1500 for coupling the sign section assembly units 12 to a source of power. The power/data distribution kit 1500 includes the central AC and data distribution kit portion 1220 to facilitate the installation of the primary hub 18, and hub mounting kit 1222 that includes primary hub mounting hardware, conduits, conduit mounting hardware, and other similar items. The kit 1210 also includes a signage installation kit 1224 utilized in hanging the individual sign section assemblies 12 to a signage mounting structure 8. This kit 1224 includes: (1) sign finishing trim 420 and trim mounting hardware 1501; (2) hanger brackets and associated mounting hardware 1503; (3) lifting brackets and mounting hardware 1505; additional compound frame to vertical member bolts 1508 and nuts 8016 (or self-drilling screws 1509); and (4) hanger clips and mounting hardware 1507.

Referring now to the manner in which the electronic sign 10 is field installed in greater detail by use of the field modification kit 1210B (FIG. 9B), the field installation assembly method 1110B (FIG. 10), is initiated from a go to step 4374 (FIG. 108) to step 4410 (FIG. 10C) at the installation site when the component assembly step 4374 ends. In this regard, the process advances to the installation site at step 4410 when the installation team arrives on site ready to begin the installation process. From step 4410, the process advances to a delivery step 4412 when all the component parts necessary for the assembly of the electronic sign 10 arrive on site. The installation process then advances to a preparation step 4414. When the field assembly kit 1210B arrives at the installation site usually by conventional transportation, the onsite installation team unloads the transportation vehicle utilizing convention construction equipment.

At preparation step 4414, the installation team prepares the existing sign for the retrofit or installation process. In this regard, the installation team removes any planar back panels of the existing sign structure 1410 thereby exposing its underlying support structure. This includes vertical support beams, horizontal support beams, diagonal support beams, cat walks and the like. For the purpose of simplicity hereinafter these support beams will be referred to individually and collectively simply as "the existing support structure" 1410.

Upon removal of the planar back panels or poster boards, the process advances to a replacement step 4416 where the installation teams adds or replaces existing support structure 1410 as necessary per local authority signage requirements. When the existing support structure 1410 has been properly updated and is ready for use the process proceeds to a mounting step 4418. It should be understood by those skilled in the art, this process could be directed to installing a new signage mounting structure that is code ready for the installation of the sign sectional assemblies to help form the display portion of the sign 10.

At the mounting step 4418, the installation team starts with the first or left most sign section assembly 9010L and readies the assembly 9010L by installing an adjustable hanging bracket 1515 to the vertical structural support member 8012 at the center of the assembly 9010L. Alternatively, hanger brackets may be used equidistant about the assembly centerline. It should be noted that if the hanging brackets are already secured (welded) to a vertical support 8012, this step of attaching the hanging bracket to the vertical support may be omitted.

Next at populate step 4419, the installation team populates all of the bay members 9016 in the sign section assembly 9010L with individual ones of the weatherized display modules, such as the display module 14. Populating the assembly 9010L before it is hoisted into position on the existing support structure 1410, results in reduced installation time, as the individual display modules do not need to be placed in a limited sized lift bucket and raised to the height of the sign for installation, in short, populating before lifting eliminates the need to utilize the limited sized lift bucket for this process. It is for this reason, the preferred method is to load the individual sectional sign assemblies with display modules in the factory rather than field installing the modules.

After the sign section assembly 9010L has been populated with display modules 14, the process continues to a lifting step 4420. At the lifting step 4420, the installation team attaches lifting hardware 1516 onto the assembly 9010L and using a crane hoist, raises the assembly 9010L onto the existing sign support structure 1410 of the existing sign. The process then advances to a hanging step 4422.

After the sign section assembly has been raised and positioned on the existing sign structure 1410, the installation team utilizing the kit provided upper hanger bracket hardware, such as the hanger bracket hardware 1512, 1515, and while keeping the hoisting crane (not shown) engaged, hang the lifted section 9010L from the upper support 1410 at hanging step 4422. It should be understood that hanger brackets are attached at marked positions selected at a chosen pre-marked height from the top of the panel per factory step 4318. From step 4422, the process advances to another hanging step 4428. At hanging step 4428, the team affixes (if necessary) lower hanger bracket hardware, 1520, 1522 to the assembly 1910L and hangs the assembly 9010L to the signage structure support 1410. This process may be repeated, if necessary. Once the sign assembly 9010L has been hung to the upper and lower supports, the hung sign section is disconnected from the hoisting crane at a disconnect step 4430.

Next, at another attachment step 4432, the team attaches upper and lower alignment guides, to the sign section assembly horizontal support 1505. The alignment guides bolt onto the support 1505 spanning the sign section seams. Horizontal supports 1505 are also bolted to the vertical support 8012. The process is ready now for adding another sign section.

Figure 10D:
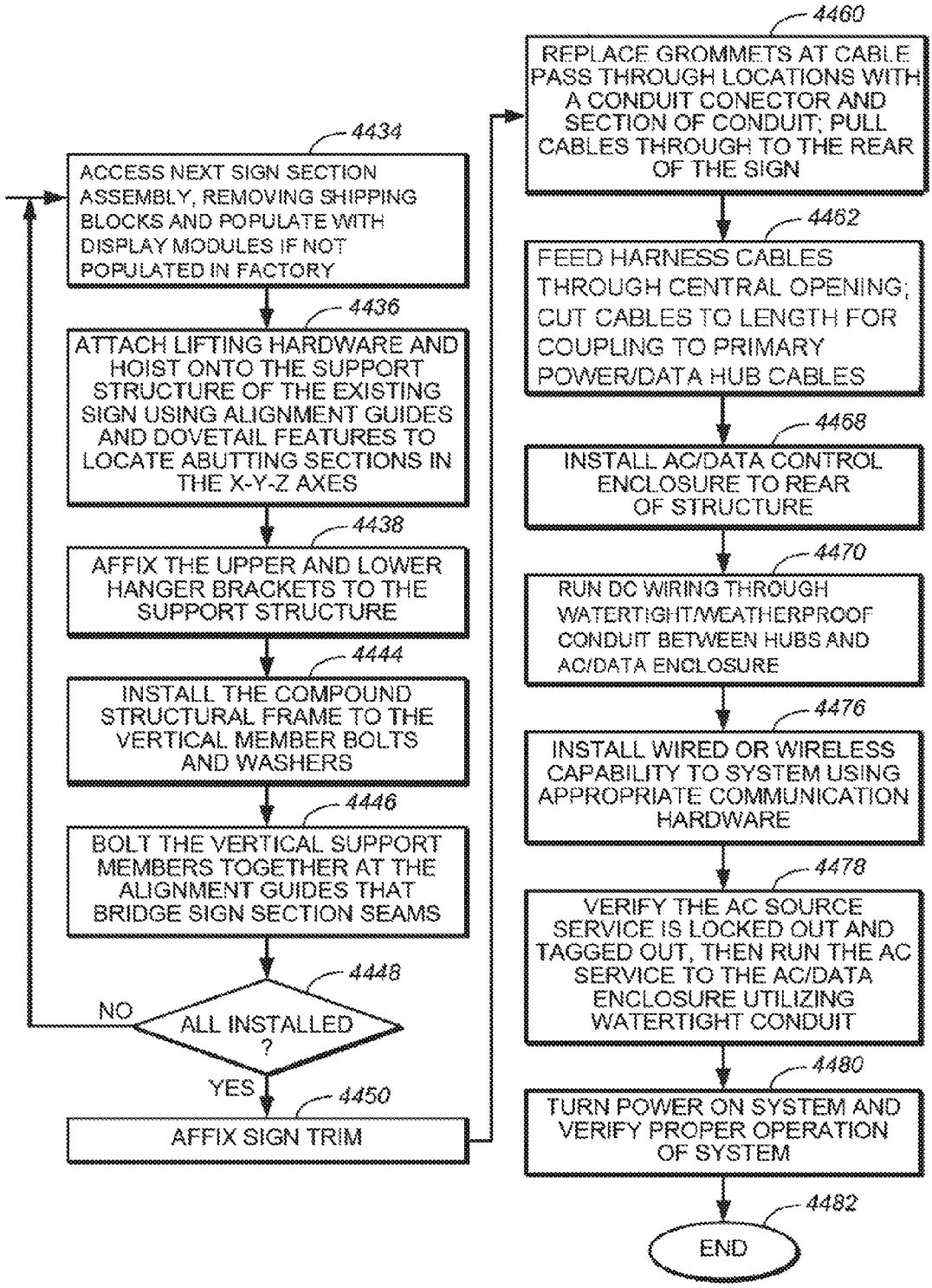

As best seen in FIG. 10D, the installation team accesses the next sign section assembly 9010C at a readying or access step 4434, where the team removes the shipping blocks 8015 associated with the next section, and then populates the assembly 9010C with its associated display modules 14. If the next section has already been populated with modules 14 at the factory, populating modules may be omitted.

Next after the assembly 90100 has been populated with display modules, at another attachment step 4436, as was done with the first left most assembly 9010L, the installation team attached to the internal assembly 9010C the lifting hardware and then using the hoisting crane, hoists the assembly 9010C onto the existing support structure 1410 using the alignment guides and the dovetail features 9194M and 9194F respectively of the compound structural frame 9012 to abut sections relative to their x-y-z axes.

After the two sections have been aligned, at another attachment step 4438, the team attaches upper and lower hanger brackets, to the sign section assembly 9010C. The hanger bracket 1515 bolts to the assembly 9010C. The process then advances to an install step 4444. At the install step 4444, the team using vertical member bolts coated with dry Loktite®, attach the structural frame of the assembly 9010C to the vertical channel support member 8012 associated with the neighbor assembly 9010L. It should be understood that if the structural frame 9016 has already been secured to the vertical support beams 8012 at the factory installation level, this step may be omitted.

Next, at another attachment step 4446, the vertical support members 8012 and or horizontal support member 8017 and alignment guides which bridge the sign section seams are bolted together. At this point, the team makes a determination at a decision step 4448 whether all the sign section assemblies associated with the sign 10 have been hung and mounted to the existing sign structure 1410. If all sections have not been hung, the team goes back to the access step 4434 and repeats each step described thereafter until all of the sign sections, including the right most section assembly 9010R have been hung and mounted to the existing sign structure 1410. When this has been accomplished, the process advances from the decision step 4448 to a trim affix step 4450 where the team affixes sign trim 420 (FIG. 1) to the hung sign section assemblies using the trim mounting hardware provided in the field modification kit 1210B.

After the sign trim 420 has been mounted, the process advances to a replacement step 4460 (FIG. 10D). The installation team at the replacement step 4460 replace grommets at all the cable pass through locations with a conduit connector and a section of the conduit C1 and then pulls cables (wire harnesses) from the front-facing portion of the compound structural frame 12 through the sheathing 9017 of the coupling structures 16 and then to the rear of the sign section assemblies.

The process then proceeds to an action step 4462, where the input cables to the satellite hubs 1710, which will eventually be coupled to the low voltage/data cables of the primary hub 1810, are pull through the central opening at the back-side of the sign now under construction, and then measured to be coupled to the primary hub 18 cables and cut to facilitate inter-connections. After the cables (wires) are cut, the cables P/D are coupled or connected to their respective satellite hubs 19 to complete the electrical interconnection between the primary power/data hub 18 and the satellite hubs 19 associated with the sign sectional assemblies. It should be understood by those skilled in the art, that the satellite hub input wiring can be factory installed and pulled in the factory to the back-side of each sign sectional assembly so that these wires may be pulled in the field to complete the electrical interconnection between the satellite hubs 19 and the primary power/data hub 18, which method is the preferred method if the display modules are pre-loaded into the sign sectional assemblies. Once all the satellite hubs 19 have been coupled to the primary power/data hub 18, the process advances to another install step 4468.

At the install step 4468, the installation team using the mounting hardware for the primary hub AC and data control enclosure 18, installs its supporting hardware proximate to the signage mounting structure 8. As best seen in FIGS. 1 and 5, this installation location of the primary hub 18 is proximate to the signage mounting structure 8, which in turn helps minimize conduit strings. In this regard, the installation team runs weatherproof flexible conduit C1 from this proximate location to the primary conduit C1 installed relative to the back-side of the sign 10

Horizontal trim members 1505 or in the alternative, vertical support members 8012 are utilized for anchoring the conduit run C2 to the rear side of the sign 10. Once the conduit run C2 have been anchored, and wires are pulled at an action step 4470, the process then advances to another installation step 4476.

At the installation step 4476 the installation team establishes data communication paths between the primary hub 18 and the satellite hubs 19. In this regard, the installation team installs either wired or wireless capability allowing the sign 10 to effect data communication using appropriate communication hardware (not shown).

Once the AC and data communication channels have been completed between the primary hub 18 and each of the display modules 14, the process advances to a verification step 4478. At the verification step 4478, the installation team verifies that the AC source service for the sign 10 is locked out and tagged out. Once this is verified, the installation team runs the AC source service for the sign 10 to the AC and data enclosure 50 using watertight conduit (not shown).

After the AC power runs have been completed at step 4478, the installation team at a power on step 4480, applies power to the sign system 10 and verifies the proper operation of the system as described earlier. Upon verification of proper sign operation, the process advances to an end step 4482.

While the present disclosure has described a process for mounting one or more sign section assembly units to the horizontal and vertical supports of an existing sign structure, the mounting of such a sign section assembly is not limited to one particular mounting structure. According to the present invention, "an existing sign structure" "an existing signage mounting structure" can include portions of or one or more of vertical beams, horizontal beams, diagonal beams, sheet metal panels, a sheet metal panelized system, a structural steel grid, a lattice structure of any appropriate ridged material, such as steel, structural foam, and plastic for example, a space frame, a billboard structure, architectural cladding, sign cabinet framing, a framed walling, a concrete walling, a planar surface. These are but a few of the surfaces that may be included as part of an existing signage mounting structure. Therefore, the present invention encompasses a wide range of structures and surfaces that form part of a pre-existing sign that can be retrofit with the retrofit kits of the present invention that include sign section assembly units, full or partial sign section assemblies, and compound structural frames whether pre-wired or wired on site. Thus, there is no intention of limiting the scope of the type of surfaces and structures that can be modified to become a dynamic electronic sign.

Figure 15:
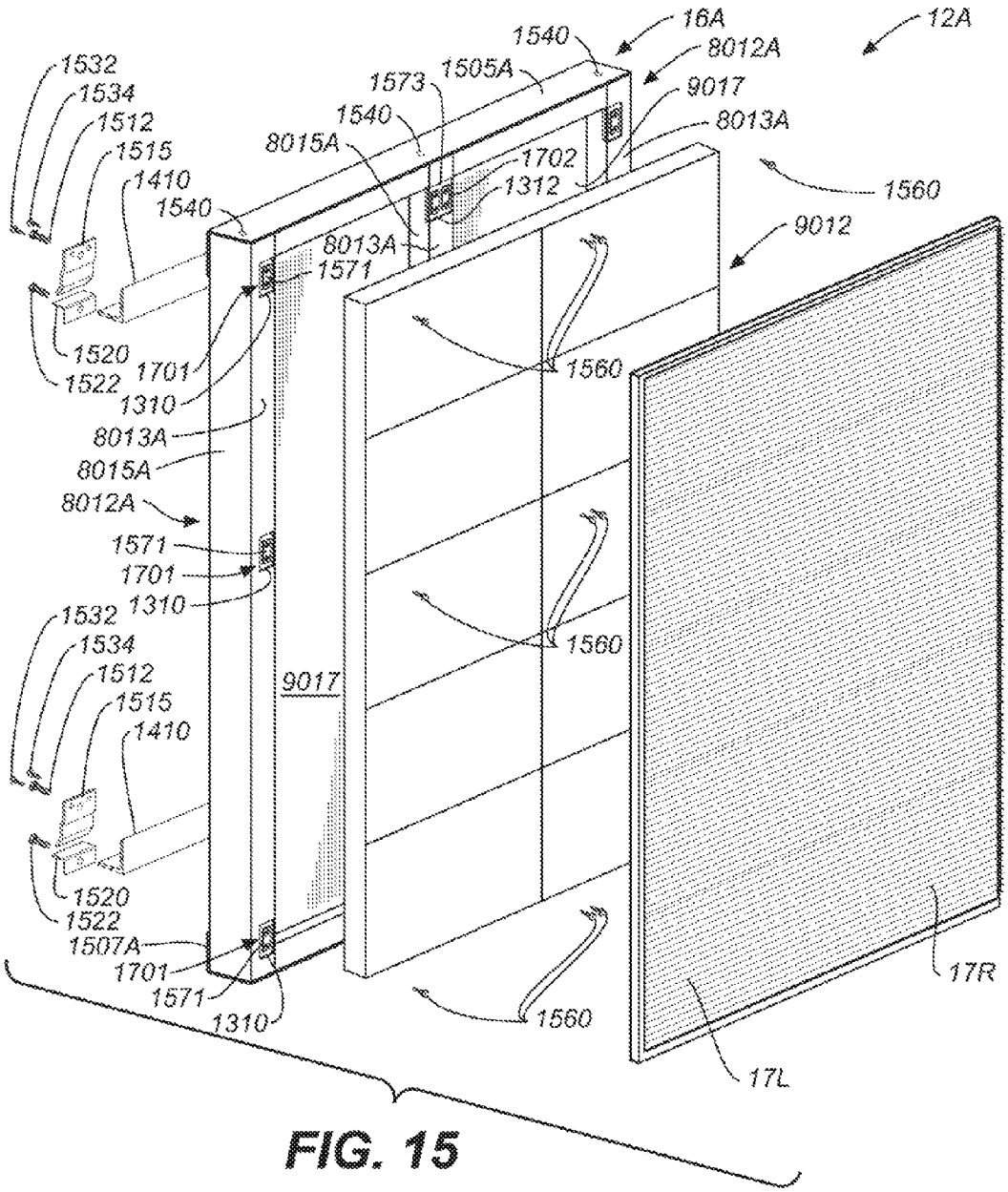
FIG. 15 is an exploded schematic view of another sectional sign assembly unit constructed in accordance with the present invention.
Figure 15A:
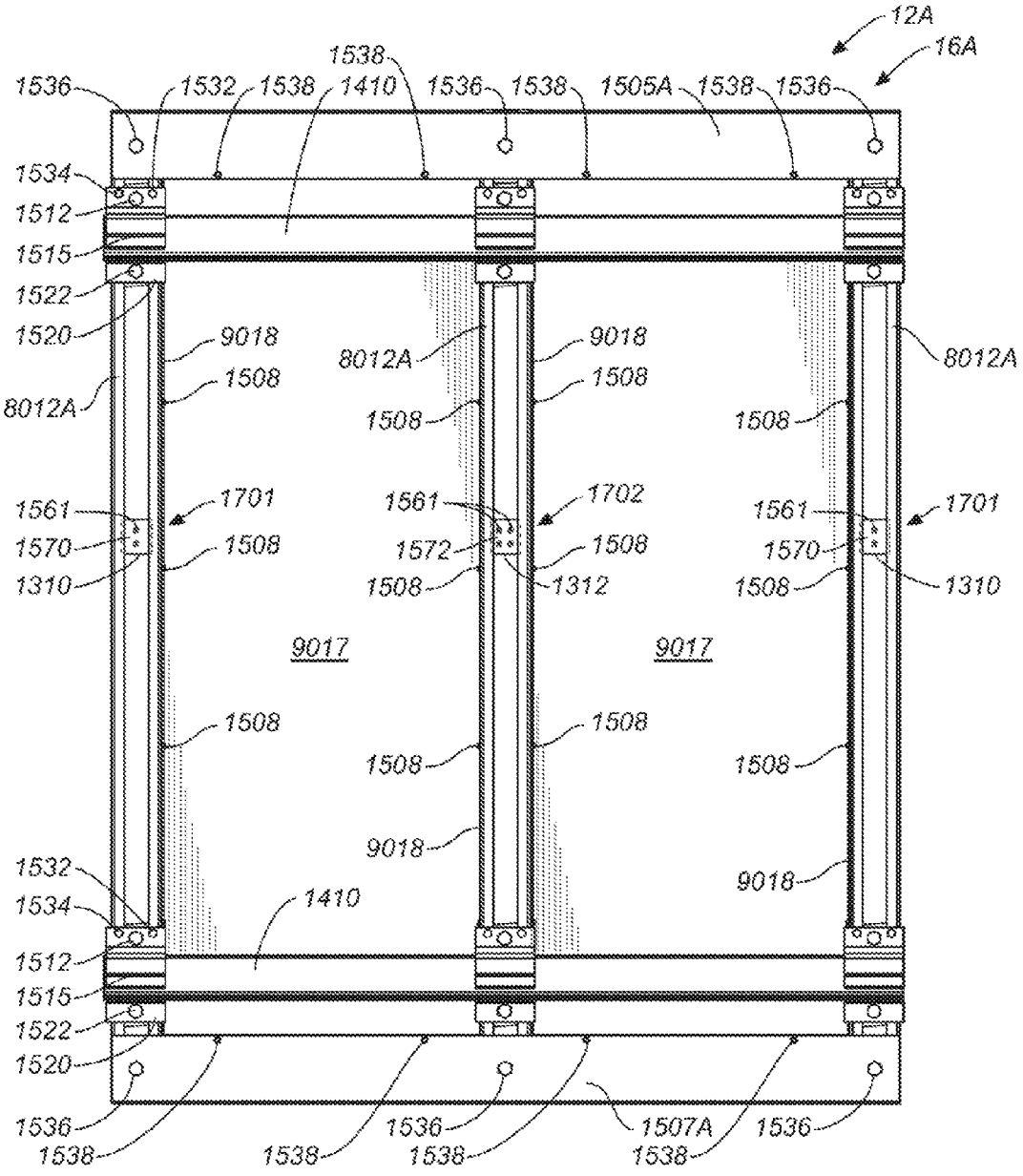
FIG. 15A is a rear elevational view of a structural signage support structure forming part of the sectional sign assembly unit of FIG. 15, illustrating its sign mounting hardware.

Referring now to the drawings and more particularly to FIGS. 15 and 15A, there is illustrated another sectional sign assembly unit 12A which is constructed in accordance with the present invention. The sectional sign assembly unit 12A is utilized in the construction of a digital sign in substantially the same manner as the sectional sign assembly unit 12 is utilized in the construction of the digital electronic sign 10. In this regard, the sectional sign assembly unit 12A generally includes at least one structural support assembly or coupling structure 16A and at least one compound structural frame 9012. The exact number of sectional sign assembly units utilized in the construction of a digital electronic sign of the present invention, is simply a function of the overall size of the digital electronic sign being constructed as previously described. In this regard, the only difference between the sectional sign assembly unit 12A and the sectional sign assembly unit 12 as previously described is: 1) in the construction of the structural support assembly 16A; and (2) how the structural support assembly 16A is mounted to its associated compound structural frame 9012. These differences in the construction of the structural support assembly 16A and how it is mounted to an associated compound structural frame will now be described.

Considering now the structural support assembly 16A in greater detail with reference to FIGS. 15 and 15A, the structural support assembly 16A generally includes a plurality of vertical structural support members, such as a vertical structural support member 8012A. The vertical structural support members 8012A are arranged in spaced apart pair sets to provide rigidity to an associated compound structural frame 9012. The structural support assembly 16A is further provided with a top trim member 1505A and a bottom trim member 1507A. The top trim member 1505A and the bottom trim member 1507A are each dimensioned to traverse the lateral distance between the vertical structural support members 8012A forming part of the structural support assembly 16A. In this regard, the top trim member 1505A and the bottom trim member 1507A provide finished top and bottom surfaces to the structural support assembly 16A.

As best seen in FIGS. 15 and 15A, the top trim member 1505A and the bottom trim member 1507A are connected into a channel nut (not shown) from their backsides with a bolt, such as a bolt 1536. The bolts 1536 and their associated channel nuts pinch the trim members 1505A and 1507A to each vertical structural support member 8012A within the coupling structure 16A to help facilitate maintaining the spaced apart distances between the vertical structural support members 8012A. This arrangement also helps stabilize and box in the structure eliminating rotation or vertical separation of the column vertical position. Each of the trim members 1505A and 1507A are provided with alignment points 1538 that define the mounting arrangement between the structural support assembly 16A and structural frame 9012. The top trim member 1505A is also provided with a set of spaced apart holes, such as an aperture hole 1540, which is dimensioned for receiving therein an eye bolt (not shown) that helps facilitate the lifting of the assembly 12A into placement for the construction of the electronic sign 10.

To provide mounting surfaces, as will be explained hereinafter in greater detail, each individual vertical support member 8012A is generally U-shaped with a front wall surface 8013A and a pair of spaced apart opposing side wall members 8015A. The front wall surface 8013A, of each vertical support member 8012A, provides a mounting surface for the compound structural frame 9012 forming part of the sectional sign assembly 12A. In a similar manner, each side wall member 8015A, of a vertical support member 8012A, provides a mounting surface for a side wall member 9018 (FIG. 15A) of a sheathing member 9017A. The sheathing member 9017A in this regard, is provided with a set of side wall members 9018 that may be secured to the pair of spaced apart opposing side wall members 8015A by self-drilling screws 1508 as best seen in FIG. 15A. In this regard, the sheathing member 9017A provides a smooth rear wall formation to the structural support assembly 16A which extends from the top to the bottom of each vertical support member 8012A. This is an important feature of the structural support assembly 16A since this facilitates the formation of a chimney like structure between the structural support assembly 16A and the compound structural frame 9012 that allows natural air flow cooling to be provided for the sectional sign assembly 12A. More specifically, when the structural support assembly 16A is secured to the compound structural frame 9012A, a chimney space S is created between the two structures that allows natural air-flow entering from the bottom of the sectional sign assembly 12A to follow a chimney vent V from the bottom of the assembly 12A to the top of the assembly 12A. Such natural air-flow cooling is an important feature of the present invention as it greatly reduces sign operating and maintenance costs since no type of cooling fans are required for the display modules mounted within the compound structural frame 9012.

As best seen in FIG. 15, the compound structural frame 9012 is secured to the structural support assembly 16A through a set of mounting bracket assemblies, such as the mounting bracket assemblies 1701 and 1702, which also function as expansion joints. In this regard, each of expansion joint bracket assemblies 1701, 1702 are configured to facilitate sliding motions both in the X and Y axes (horizontal and vertical directions, respectively), but be retained in the Z-axis. In one preferred embodiment the designed horizontal expansion is 0.0687 inches and the vertical expansion is 0.25 inches. This configuration therefore handles differential dimensional changes between each structural support assembly 16A and its associated compound structural frame 9012, which changes are caused by temperature fluctuations.

Considering now the mounting bracket assembly 1701 in greater detail with reference to FIG. 15, the mounting bracket assembly 1701 generally includes a pair of sheet metal plates in the form of a front plate 1571 and a rear plate 1570. In this regard, the front plate 1571 and rear plate 1570 are captured in window cutouts indicated generally at 1310, which are disposed in the outside vertical support members 8012A of the coupling structure 16A. These window cutouts 1310 are sized to allow the expansion joint to float in X and Y directions, but contained in the Z axis by the expansion joint back plate 1570. In this regard, there is an AVK nut 1561 which extends through the expansion joint. The AVK nut 1561 is a compression installed nut that is captured in the expansion rear or back plate 1570, which nut cooperates with a compound structural frame mounting bolt, such as a mounting bolt 1560 to facilitate fastening the compound structural frame 9012 to the sign structural support assembly 16A. As best seen in FIG. 15, there are three spaced apart expansion joints provided in each of the outside vertical support members 8012A.

In a similar manner, the inside vertical support member 8012A which is disposed between the two outside vertical support members 8012A is provided with three spaced apart expansion joints defined by like mounting bracket assemblies, such as a mounting bracket assembly 1702. Mounting bracket assembly 1702 is larger than mounting bracket assembly 1701 and is defined by a front plate 1705 and a rear plate 1572, which are captured in window cutouts 1312. The window cutouts 1312, like window cutouts 1310, are sized to allow the expansion joints disposed in center vertical support member 8012A to float in the same manner as previously described relative to assembly 1701. In this regard, a set of AVK or self-locking nuts or fasteners 1561 extend through these expansion joints, where the AVK nuts functions as previously described; e.g. the AVK nuts cooperates with compound structural frame mounting bolts, such as a mounting bolt 1560 to facilitate fastening the compound structural frame 9012 to the sign structural support assembly 16A.

CONCLUSION

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Applicants reserve the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in "haec verba" in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a" "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the following claims.

For example, although the dynamic display of the present invention as described herein is installed on poster panels of an existing sign, it is contemplated that a cabinet type electronic display system could also be modified by stripping the cabinet of its display modules and electrical system leaving an open faced cabinet frame. A structural planar back panel could then be mounted to the open face area of the open faced cabinet frame. This structural planar back panel would then serve and function as the planar mounting surface for the retrofit kit 10 in the same manner as a field sign. The cabinet structure originally installed would remain in place but would be modified as described herein.

As another example, a building face surface of a multi-store or single story building could be modified by the installation of a structural planar back panel of any suitable structural material (sheet metal, wood, structural foam, plastic, etc.) with surface to surface standoffs to provide sufficient spacing for installation of the power system described herein. In this regard, the power and data junction boxes would be installed on the back-side of the planar back panel so as to be disposed spaced from the exterior surface of the building. In an alternative configuration, the planar back panel could be installed flat against the exterior surface of the building and power access for front mounted display modules could be provided from junction boxes installed inside the building and routed to a structural planar back panel mounted on the exterior surface of the building. This structural planar back panel would then serve and function as the planar mounting surface for the retrofit, kit 10 in the same manner as the poster panels of an infield sign.

Therefore, provided herein is a new and improved in field retrofit kit for converting a static non electronic sign into a dynamic electronic sign and methods of retrofitting a static sign in the field in a fast and convenient manner without the need of special equipment. The following specific features are deemed important and unique:

Harnesses: By utilizing the frame as a raceway (as opposed to running cables through a conduit), there are less design limitations. For example: (1) connectors, or multiples of connectors would be difficult to pull through conduits, which would more likely than not result in multiple conduits to avoid this problem; (2) alternately, such harnesses may have to be replaced with cabling that is pulled through conduits, with the connectors then added in the field. Quality control and build time issues would then become a problem, which is not an issue with the present invention; and (3) utilizing conduit and cables as opposed to the disclosed structural frames and preformed harness design would result in more sign real estate required for conduit, especially at bends where there is a minimum radius requirement; more material costs, and greater labor costs for installing conduits, cable routing and connector installation. Again, the structural frame and harness design of the present invention eliminates all of these issues.

Safety of Installation: HVAC power is rectified to substantially less than 30 VDC from the back-side of the sign 10 to the front-side of the sign 10. In this regard, safety and practicality for workers to install and service the sign 10 is of paramount importance. Higher direct current voltages or line voltages represent pending safety hazards and may affect the required skill level of the person or persons installing the sign 10. Use of the substantially less than 30 VDC power eliminates the need for such skill labor during the installation and maintenance of the sign 10.

Compound Frames with Specific Arrays: The new and improved sign 10 is optimized for panel form factor and assembly efficiency. In this regard, the 4 foot by 5 foot form factor selected for the structural frames 12 is optimized for the size of existing static panels which will be utilized in the retrofit process. Moreover, with the use of compound frames, such as the compound structural frames 12, the number of frames required to be mated with an existing panel board is greatly reduced.

Structural Foam Use: Ease of mating a structural frame 12 with an existing static signage structural mounting structure 8, is achieved with the large, light-weight structural frames, such as the structural frame 12, which have a unitary construction prepared from injected structural foam. This is a key factor in the design criteria of the present invention; namely substantial weight reduction coupled with simple and effective molding constraints. In short, the utilization of large 4 foot by 5 foot frames is the optimal way of fabrication. That is, injection molding would make molding costs prohibitive and would make the overall weight of the individual panels too excessive for a worker to lift and place in position without using special equipment during installation. The structural foam construction of the individual frames 12 imparts to the individual frame unusual strength and durability effectively weatherizing the frames against strong buffeting winds for example. The structural foam in fact is so strong that it may be used in other applications as a structural building material or a form of heavy-duty furniture.

Bee Stops and Vent Chimney Screens: To help prevent local insects and ground animals, such as bees, wasps, flies, rodents, squirrels and the like from finding shelter between the panel boards of the signage structure 8 and the structural frames 12 of a converted sign 10, each installation kit includes a plurality of bee stops, such as a bee stop 98 described in U.S. Pat. No. 9,047,791 that is utilized to close off the electrical pass troughs on the end of the array structural of a structural frame 12. Pass through notches uniquely enable the vertical routing of data connections, which at the same time, in combination with the bee stops prevent the invasion of such flying insects into the cooling vents and electrical conduit passageways.

Ease of Operating Latches: The structural frames and bay members are configured with mutual mechanical datum structures coupled with central power and data connectors that provide for effective and easy installation and release of the individual LED display modules 14 relative to an associated bay member 16. That is, the module latches 412, which help secure each display modules within its associate bay member 16, is made ready to be acted upon through strategically placed latch access openings 17H disposed in each display module 14, as more fully described in U.S. Pat. No. 9,330,583.

In combination then, the installation or retrofit kits described herein enables a static signage mounting structure, such as structure 8 to be easily and quickly converted into a dynamic electronic sign, such as the sign 10 by assembling an array of structural bays 16 upon an existing standing panel of the static billboard signage structure 8. Each bay member 16 in this arrangement, includes a power and data connector for coupling power and data to an individual display module 14, a strategically placed alignment features, and a uniquely operable latching feature, which operate or cooperate with a complementary set of display module 14 features including a module data and power connector, a module alignment feature, and a module latching feature for enabling a display module 14 to be mechanically and electrically coupled to a bay member 14 for dynamically displaying sign information. Advantageously, each display module 14 is also provided with a weatherized sealing design which protects the electronics and completely eliminates the need for a rigorous weather seal which would otherwise be needed between the module 14 and the bay member 16. In this regard, the otherwise needed rigorous weather seal is eliminated by a unique and novel perforated channel member which is filled with a potting compound in order to weatherize and seal the display module 14. Moreover, the weatherized modules protect the cabling from the degradation effects of ultra-violet sunlight.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the following claims.

We claim:

1. An electronic sign configured to be secured to a signage, mounting structure, comprising:

at least one pre-wired sectional sign assembly having a front-side defining an array of display module receiving bays, wherein each display module receiving bay has removably latched therein a display module and wherein at least one of the display module receiving bays has mounted therein a condensed extender enclosure electrically coupled between a power converter mounted proximate to the signage mounting structure and a plurality of cord-like extensions, each extension terminating at a corresponding individual one of the display module receiving bays and each terminating in a power plug configured to be coupled to a complementary power plug extending from a corresponding individual one of the display modules;

a coupling structure mounted to a back-side of the at least one pre-wired sectional sign assembly, the coupling structure having at least a pair of spaced apart vertical beams with a sheeting member mounted therebetween to help facilitate the formation of an airflow vent between the pre-wired sectional sign assembly and the coupling structure for providing natural airflow cooling for each display module removably latched in a corresponding one of the display module receiving bays; and wherein each beam is configured to carry at least one mounting bracket to facilitate mounting the pre-wired sectional sign assembly to the signage mounting structure.

2. The electronic sign according to claim 1, wherein the at least one pre-wired sectional sign assembly includes at least one structural frame having a front-side and a back-side, the front-side defining the array of display module receiving bays and the back-side having at least one airflow channel for receiving therein a cooling designated portion of individual ones of the display modules to provide the cooling designated portion with natural air flow cooling from air flowing within the airflow vent.

3. The electronic sign according to claim 2, wherein each individual vertical beam has a frame mounting surface, a channel opposing the frame mounting surface, and a pair of opposing sheeting member mounting surfaces.

4. The electronic sign according to claim 3, wherein the sheeting member is mounted between opposing sheeting member mounting surfaces and wherein the back-side of the at least one structural frame is mounted to the frame mounting surface of each of the at least a pair of spaced apart vertical beams.

5. The electronic sign according to claim 2, wherein the at least one structural frame has a unitary construction.

6. The electronic sign according to claim 5, wherein the at least one structural frame is composed of structural foam.

7. An electronic sign comprising:

a sign section assembly having a front portion and a rear portion; said front portion defining an array of display module receiving bays, and said rear portion configured to be coupled to a beam surface of a signage mounting structure; and a power/data routing system including a primary power/data hub, and at least one satellite power/data hub with a plurality of power extensions extending therefrom, wherein each individual one of the plurality of power extensions terminate in corresponding individual ones of the display module receiving bays to facilitate coupling power and data to individual ones of a plurality of display modules removably latched within the corresponding individual ones of the display module receiving bays.

8. The electronic sign according to claim 7, wherein the at least one sign section assembly includes a plurality of structural frames secured to at least one structural signage support;

wherein each individual one of the plurality of structural frames is provided with an condensed extender enclosure mounted within an individual one of the display module receiving bays; and wherein the condensed extender forms part of the at least one direct current power and data satellite hub.

9. The electronic sign according to claim 7, wherein the sign section assembly includes at least one structural frame secured to at least one structural signage support;

wherein the at least one structural signage support includes at least a pair of spaced apart vertical beams, each vertical beam having mounted thereto at least one mounting bracket for helping to support the sign section assembly to the signage mounting structure;

wherein the at least one structural signage support further includes at least one sheeting member with upwardly extending side wall members to facilitate mounting of the at least one sheeting member between the at least a pair of spaced apart vertical beams; and wherein the at least one sheeting member is spaced a sufficient distance from a back-side of the at least one structural frame to help form a natural airflow chimney therebetween, the natural airflow chimney extending from a top-side of the at least one structural frame a bottom-side of the at least one structural frame to facilitate cooling the individual ones of the plurality of display modules removably latched within the corresponding individual ones of the display module receiving bays.

10. The electronic sign according to claim 9, wherein each individual vertical beam is a strut formed from a metal sheet, folded over into an open box-like channel shape having a base member with rearwardly extending spaced apart legs members with inwardly formed lips for receiving therebetween the at least one mounting bracket; and wherein the rearwardly extending spaced apart leg members are provided with a plurality of mounting holes to facilitate the mounting of the at least one sheeting member between the at least a pair of spaced apart vertical beams.

11. The electronic sign according to claim 7, further comprising:

a data routing system coupled to the at least one power distribution extension system to facilitate providing display data to individual ones of the plurality of display modules.

12. The electronic sign according to claim 7, wherein the power converting system mounted proximate to the signage mounting structure includes a primary power enclosure having disposed therein a power converter coupled to a source of high voltage alternating current power; and wherein the power converted is an AC to DC power converter for converting high voltage alternating current power to low voltage direct current power; and wherein each individual one of the plurality of power distribution extension systems includes at least one condensed extender enclosure mounted with in an individual one of the display module receiving bays, the condensed extender enclosure having mechanically and electrically mounted thereto the plurality of power extensions.

13. The electronic sign according to claim 12, wherein each individual one of the plurality of power extensions terminate in corresponding individual power plug, each configured to be mechanically and electrically coupled to a corresponding complementary display module power plug to facilitate coupling power to individual ones of the plurality of display modules as each is received within corresponding individual ones of the display module receiving bays.

14. The electronic sign according to claim 9, wherein each display module includes a front-facing portion and a rear facing portion, wherein the front facing portion is mounted within a corresponding one of the display module receiving bays to facilitate forming a portion of the display area of the electronic sign; and wherein the rear facing portion is mounted within the natural airflow chimney extending from the bottom-side of the at least one structural frame to the top-side of the at least one structural frame to facilitate cooling the individual ones of the plurality of display modules removably latched within the corresponding individual ones of the display module receiving bays.

15. The electronic sign according to claim 7, wherein each individual one of the plurality of power distribution extension systems includes at least one condensed extender enclosure mounted within an individual one of the display module receiving bays, the condensed extender enclosure having mechanically and electrically mounted thereto the plurality of power extensions.

16. The electronic sign according to claim 7, wherein the sign section assembly includes at least two structural frames secured to et least one structural signage support;

wherein the at least structural signage support includes at least a pair of spaced apart vertical beams, each vertical beam having mounted thereto at least one mounting bracket for helping to support the sign section assembly to a signage mounting structure;

wherein the at least one structural signage support further includes at least one sheeting member with a pair of upstanding side walls to facilitate mounting of the at least one sheeting member between the at least a pair of spaced apart vertical beam; and wherein the at least one sheeting member and the at least two structural frames cooperate when mounted to the at least one structural signage support to help form a natural airflow chimney therebetween, the chimney extending from a top-side of the sign section assembly to a bottom-side of the sign section assembly to facilitate cooling the individual ones of the plurality of display modules removably latched within the corresponding individual ones of the display module receiving bays.

17. The electronic sign according to claim 16, wherein the power converting system mounted proximate to the signage mounting structure includes a primary power enclosure having disposed therein a power converter coupled to a source of high voltage alternating current power, the power converter for converting high voltage AC power to low voltage DC power; and wherein each individual one of the plurality of power distribution extension systems includes at least two condensed extender enclosures, each mounted in an individual one of the display module receiving bays in a corresponding one of the structural frames; and wherein each individual one of the at least two condensed extender enclosures have mechanically and electrically mounted thereto the plurality of power extensions.

18. The electronic sign according to claim 17, wherein the at least two structural frames are mounted in a stack in a dove-tailed configuration; and wherein the at least two structural frames, each have a unitary construction and are composed of injected structural foam.

19. An electronic sign, comprising:

at least one sectional sign assembly loaded with a plurality of display modules, the at least one sectional sign assembly having at least one structural frame mounted to a signage support for facilitating providing the plurality of display modules with natural airflow cooling and for helping to facilitate the lifting and mounting of the at least one sectional sign assembly to a signage mounting structure;

a power converting system for converting high voltage alternating current electrical power into a source of low voltage direct current electrical power, the power converting system being mounted proximate to the signage mounting structure and the sectional sign assembly;

wherein the signage support includes at least a pair of spaced apart vertical beam members, each beam configured to have mounted thereto at least one mounting bracket for helping to support the at least one sectional sign assembly from the signage mounting structure, and at least one sheeting member mounted between the at least a pair of spaced apart vertical beams to help provide the signage support with a front-wall configuration to facilitate the forming of a natural airflow chimney;

wherein the sectional sign assembly mounted to the signage support is arranged in a generally rectangular configuration with a front-facing portion, a rear-facing portion, a top surface, a bottom surface, a right-side surface and a left-side surface, wherein the sectional sign assembly and the at least one sheeting member of the signage support when mounted to the at least a pair of spaced apart vertical beam members cooperate to form the natural air flow chimney;

wherein the front-facing portion and the rear-facing portion in combination define a plurality of display module receiving bays, each display module receiving bay having removably latched therein a display module with one portion thereof mounted within the natural airflow chimney and another portion thereof mounted within the front-facing portion, the another portion including a power plug for facilitating providing the display module with low voltage direct current electrical power;

wherein one of the plurality of display module receiving bays has mounted therein an condensed extender enclosure with a plurality of display module power cords, each display module power cord terminating in a complementary power plug configured to be electrically and mechanically coupled to a display module power plug when the corresponding display module is received within a corresponding display module receiving bay; and a power routing systems coupled mechanically and electrically between the power converting system and the condensed extender enclosure for providing the plurality of display module power cords with low voltage direct current electrical power.

* * * * *